US011532419B2

(12) United States Patent
Murakami et al.

(10) Patent No.: US 11,532,419 B2
(45) Date of Patent: Dec. 20, 2022

(54) COIL COMPONENT

(71) Applicant: SUMIDA CORPORATION, Tokyo (JP)

(72) Inventors: Asami Murakami, Natori (JP); Toshimasa Monma, Natori (JP)

(73) Assignee: SUMIDA CORPORATION

( * ) Notice: Subject to any disclaimer, the term of this patent is extended or adjusted under 35 U.S.C. 154(b) by 504 days.

(21) Appl. No.: 16/692,091

(22) Filed: Nov. 22, 2019

(65) Prior Publication Data

US 2020/0203052 A1 Jun. 25, 2020

(30) Foreign Application Priority Data

Dec. 21, 2018 (JP) ..... JP2018-240067
Aug. 9, 2019 (JP) ..... JP2019-147142

(51) Int. Cl.

*H01F 27/02* (2006.01)
*H01F 27/24* (2006.01)
*H01F 27/29* (2006.01)
*H01F 41/06* (2016.01)

(52) U.S. Cl.

CPC ..... *H01F 27/02* (2013.01); *H01F 27/24* (2013.01); *H01F 27/29* (2013.01); *H01F 41/06* (2013.01)

(58) Field of Classification Search

CPC ..... H01F 27/02; H01F 27/04; H01F 27/24; H01F 27/29; H01F 27/292; H01F 41/06; H01F 17/04; H01F 17/06; H01F 2017/0093; H01F 27/266; H01F 27/306; H01F 27/30; H01F 27/2828

See application file for complete search history.

(56) References Cited

U.S. PATENT DOCUMENTS

2009/0115551 A1* 5/2009 Kobayashi ..... H01F 17/045 336/92
2014/0292456 A1* 10/2014 Suzuki ..... H01F 27/29 336/55
2017/0309392 A1* 10/2017 Kobayashi ..... H01F 27/2823
2018/0097497 A1* 4/2018 Kobayashi ..... H01F 19/08
2018/0308625 A1* 10/2018 Hasegawa ..... H01F 27/022

(Continued)

FOREIGN PATENT DOCUMENTS

JP H08-213242 A 8/1996
JP 2006-173201 A 6/2006
JP 2008-244116 A 10/2008

(Continued)

OTHER PUBLICATIONS

Extended European Search Report for corresponding Application No. EP 19218529.6 dated May 8, 2020 (8 pages).

*Primary Examiner* — Mang Tin Bik Lian
(74) *Attorney, Agent, or Firm* — Harness, Dickey & Pierce, P.L.C.

(57) ABSTRACT

A coil component includes: a core having first and second shafts arranged in a line, and first and second opposed members; a case supporting the core and having a housing accommodating the core, and first and second outer walls opposing each other; a coil wound around the first and second shafts; and first and second metal terminals being electrically connected to the coil and being provided at the first and second outer walls, respectively. The first and second opposed members are opposed to each other and sandwich the first and second shafts therebetween.

21 Claims, 11 Drawing Sheets

(56) References Cited

U.S. PATENT DOCUMENTS

| | | | | |
|---|---|---|---|---|
| 2018/0350501 | A1* | 12/2018 | Hasegawa | H01F 17/06 |
| 2019/0206615 | A1* | 7/2019 | Suzuki | H01F 37/00 |

FOREIGN PATENT DOCUMENTS

| | | | | |
|---|---|---|---|---|
| JP | 2016-184990 | A | | 10/2016 |
| JP | 2018-014459 | | * | 1/2018 |
| JP | 2018019027 | A | * | 2/2018 |

* cited by examiner

COIL COMPONENT

CROSS-REFERENCE TO RELATED APPLICATIONS

This application claims priority to Japanese Patent Application Nos. 2018-240067 filed Dec. 21, 2018, and 2019-147142 filed Aug. 9, 2019 which are hereby expressly incorporated by reference herein in their entirety.

BACKGROUND

1. Technical Field

The present invention relates to a coil component.

2. Related Art

A conventional coil component is, for instance, a common mode choke coil that is described in Japanese Patent Publication Number H08-213242.

The coil component that is described in Japanese Patent Publication Number H08-213242 is configured with two bobbins, a coil, a pair of cores, a base, and a pin-shaped terminal. Specifically, the two bobbins are coaxially arranged. The coil is wound around each bobbin. One side of the pair of cores is inserted into each bobbin. The base supports these cores. Further, the pin-shaped terminal protrudes from a back (bottom) surface of the base.

According to the investigation of the inventors of the present application, there is room for improvement in the withstand voltage (breakdown strength or breakdown voltage) performance between the terminal and the core in the configuration of the coil component that is described in Japanese Patent Publication Number H08-213242.

SUMMARY

The present invention attempts to achieve the above improvement. An object of the present invention is to provide a coil component that has a configuration that enables sufficiently ensuring withstand voltage (breakdown strength or breakdown voltage) performance between a terminal and a core.

According to one aspect of the present invention, a coil component includes a core member, a case, a coil, and first and second terminals. The core member includes first and second shafts being arranged in parallel and first and second opposed members. The first opposed member spans between one end of the first and second shafts. The second opposed member spans between the other ends of the first and second shafts. The case supports the core member. The case is made of an insulating material. The case is configured with a housing member accommodating the core member and first and second outer walls opposed to each other. The core member is disposed between the first and second outer walls. The coil is wound around the first and second shafts. The first and second metal terminals are electrically connected to the coil. The first and second metal terminals are provided at the first and second outer walls, respectively. The first and second opposed members are opposed to each other and sandwich the first and second shafts therebetween.

According to the present invention, the withstand voltage (breakdown strength or breakdown voltage) performance between a terminal (a metal terminal member) and a core member can be sufficiently ensured.

DESCRIPTION OF EXEMPLARY EMBODIMENTS

Figure 1:
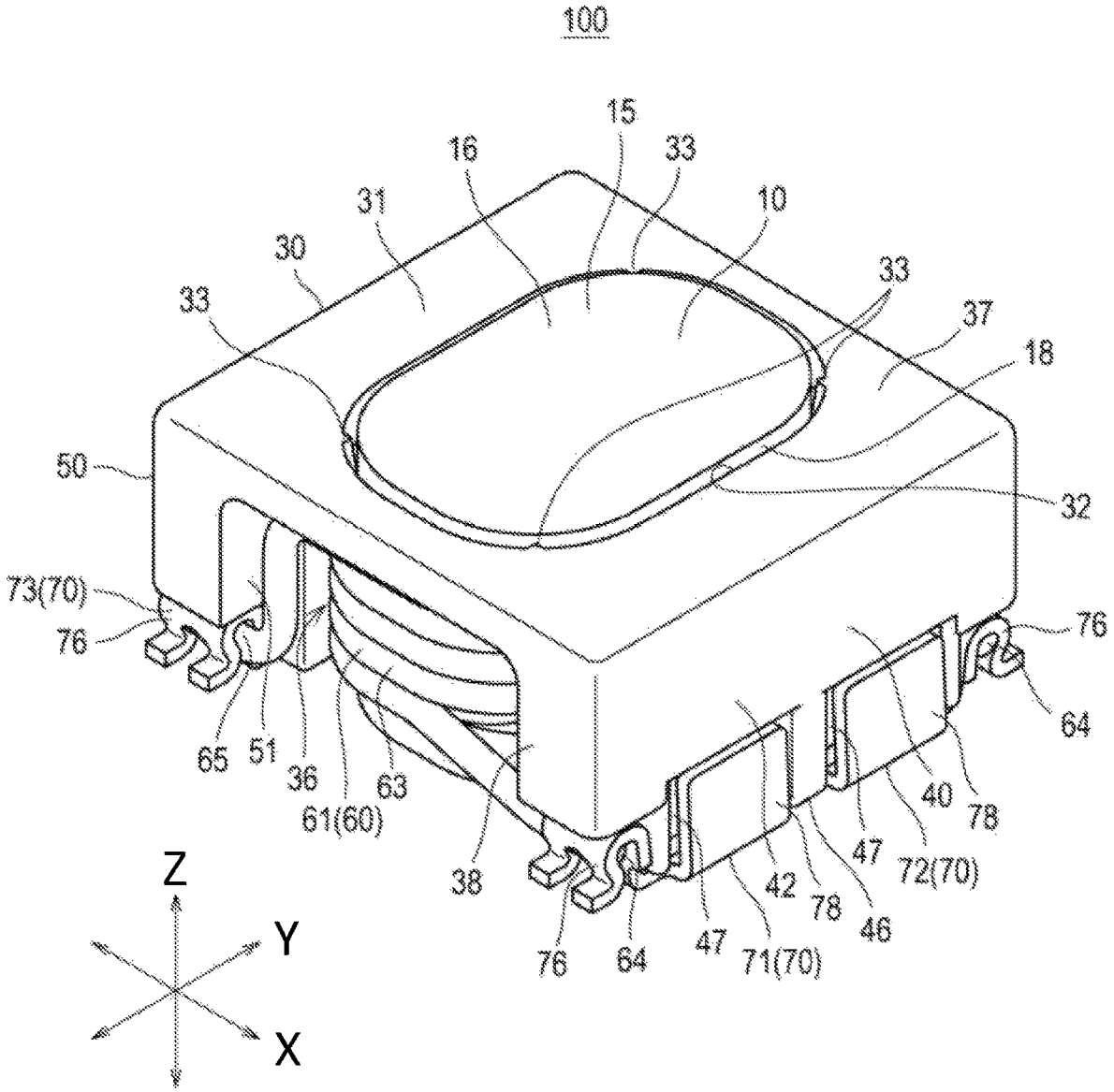
FIG. 1 is a perspective view that shows a coil component according to embodiments of the present invention.

As discussed below, embodiments according to the present invention are explained with reference to FIGS. 1-9. In regards to the embodiments, redundant explanations with respect to the same configurations are omitted but the same reference numerals are used for labeling in the drawings.

Figure 7:
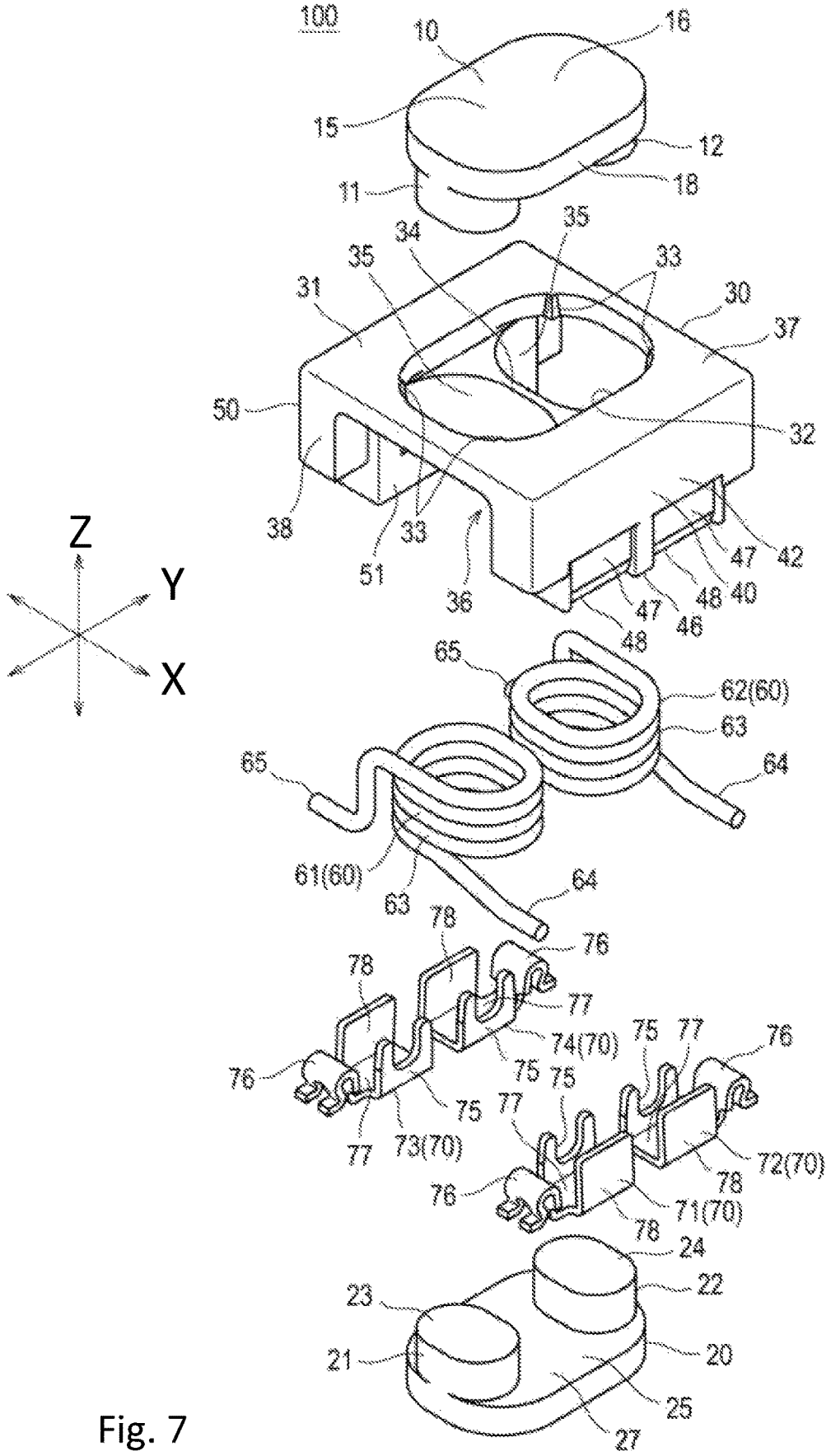
FIG. 7 is an exploded perspective view that shows the coil component according to the embodiments of the present invention.

As shown in FIG. 7, a coil component 100 according to the embodiments of the present invention has a core member, a case member 30, a coil (coils) 60, and metal terminal members 70. The core member is configured with a pair of shaft parts (shafts or posts) (11 and 21, and 12 and 22), a first opposed part (a first connection part 15) and a second opposed part (a second connection part 25). Specifically, the pair of shaft parts are provided in parallel with each other. That is, the pair of shaft parts are arranged in a line. The first opposed part (the first connection part 15) is provided over (spans) one end of each of the pair of shaft parts. The second opposed part (the second connection part 25) is provided over (spans) the other ends of the pair of shaft parts. The case member 30 is made of (is configured by) an insulating material and supports the core member. The coils 60 are wound around the pair of shaft parts. The metal terminal members 70 are electrically connected to the coils 60.

Figure 3:
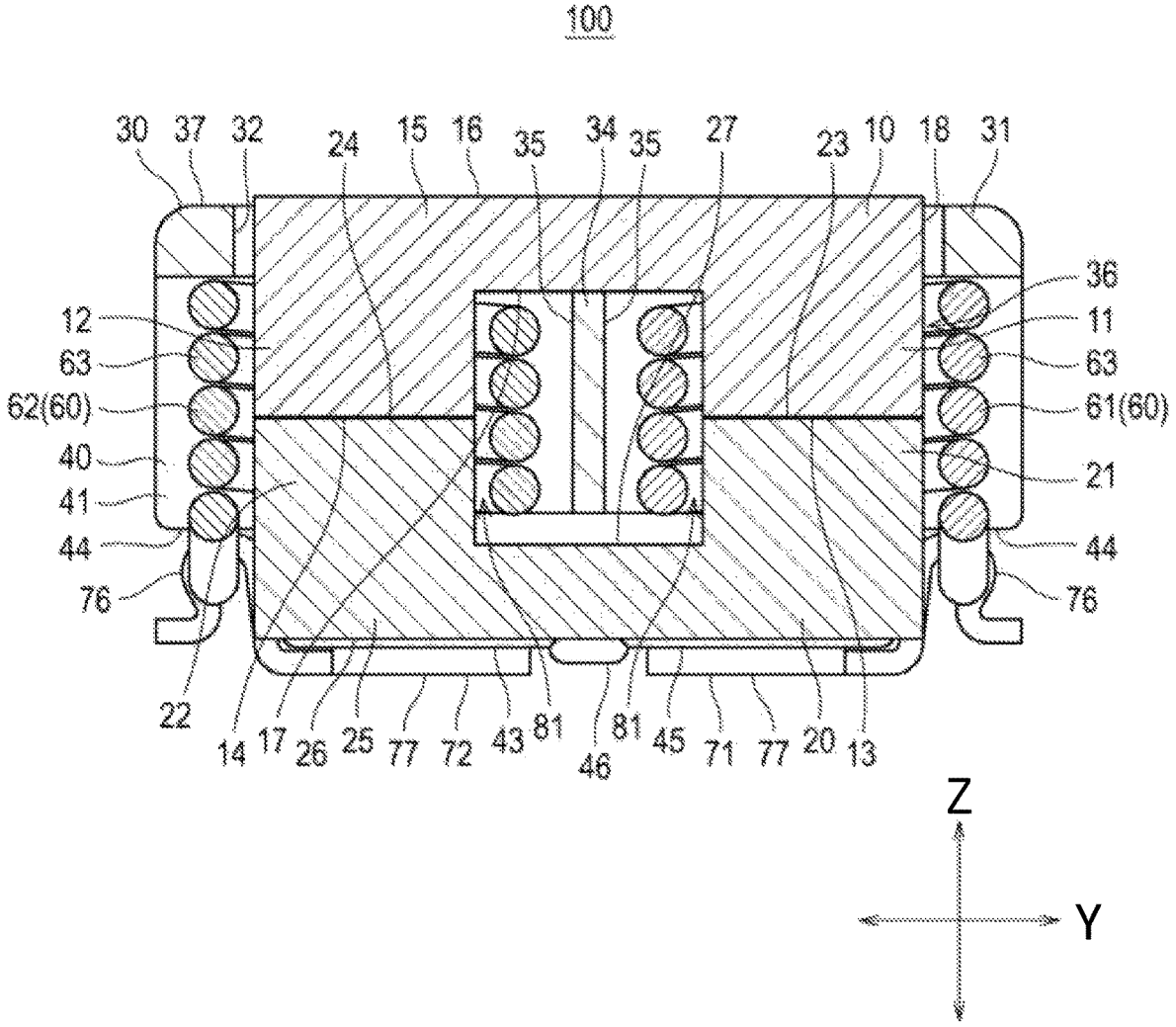
FIG. 3 is a cross-sectional view along the line A-A shown in FIG. 2 according to the embodiments of the present invention.

As shown in FIG. 3, the first and second opposed parts are provided to face (opposed to) each other by sandwiching the pair of shaft parts therebetween.

The case member 30 has a housing member (housing space or storage space) 36 and a pair of outer wall parts (walls) 40 and 50. Specifically, the housing member 36 accommodates the core member. The pair of outer wall parts 40 and 50 are provided to face (opposed to) each other by sandwiching (inserting or disposing) the core member therebetween. At the same time, the pair of outer wall parts 40 and 50 are respectively and vertically erected.

Further, the metal terminal member 70 is provided at each of the pair of outer wall parts 40 and 50.

According to the embodiments of the present invention, the coil component 100 has a configuration in which the metal terminal member 70 that is electrically connected to the coil 60 is provided at each of the outer wall parts 40 and 50 of the case member 30 that is made of the insulating material. As a result, the withstand voltage (breakdown strength or breakdown voltage) performance between the terminal (the metal terminal member 70) and the core member of the coil component 100 can be sufficiently ensured. That is, an insulation distance (spacing for insulation) between the terminal and the core member can be ensured.

In the present embodiment, the core member is configured by a first core 10 and a second core 20. That is, the core member has the first core 10 and the second core 20. Specifically, the first core 10 has a pair of first shaft parts 11 and 12 that are provided in parallel with each other and the first opposed part (the first connection part 15). The second core 20 has a pair of second shaft parts 21 and 22 that are provided in parallel with each other and the second opposed part (the second connection part 25).

The first opposed part (the first connection part 15) is connected between the pair of first shaft parts 11 and 12. The second opposed part (the second connection part 25) is connected between the pair of second shaft parts 21 and 22.

As shown in FIGS. 3 and 7, a first sub-shaft part 11 of the pair of first shaft parts 11 and 12 and a second sub-shaft part 21 of the pair of second shaft parts 21 and 22 are coaxially provided with each other so as to form one of the pair of shaft parts. Similarly, a first sub-shaft part 12 of the pair of first shaft parts 11 and 12 and a second sub-shaft part 22 of the pair of second shaft parts 21 and 22 are coaxially provided with each other so as to form the other of the pair of shaft parts.

That is, in the present embodiment, the core member is configured by combining two U-shaped cores together (the first core 10 and the second core 20).

That is, the coil component 100 according to the embodiments of the present invention has the first core 10, the second core 20, the case member 30, the coils 60, and the metal terminal members 70. The first core 10 has the pair of first shaft parts 11 and 12, and the first connection part 15. Specifically, the pair of first shaft parts 11 and 12 that are provided in parallel with each other. The first connection part 15 is connected between the pair of first shaft parts 11 and 12. The second core 20 has the pair of second shaft parts 21 and 22, and the second connection part 25. Specifically, the pair of second shaft parts 21 and 22 that are provided in parallel with each other. The second connection part 25 is connected between the pair of second shaft parts 21 and 22. The case member 30 is made of the insulating material and supports the first core 10 and the second core 20. The coils 60 are wound around the first shaft parts 11 and 12, and the second shaft parts 21 and 22. The metal terminal members 70 are electrically connected to the coils 60.

As shown in FIG. 3, the first connection part 15 and the second connection part 25 are provided to face (opposed to) each other by sandwiching the pair of first shaft parts 11 and 12, and the part of second shaft parts 21 and 22 therebetween. The first shaft part 11 (one) of the pair of first shaft parts 11 and 12 and the second shaft part 21 (one) of the pair of second shaft parts 21 and 22 are coaxially provided with each other. The first shaft part 12 (the other) of the pair of first shaft parts 11 and 12 and the second shaft part (the other) of the pair of second shaft parts 21 and 22 are coaxially provided with each other.

The case member 30 has the housing member (housing space or storage space) 36 and the pair of outer wall parts 40 and 50. Specifically, the housing member 36 accommodates the first core 10 and the second core 20. The pair of outer wall parts 40 and 50 are provided to face (opposed to) each other by sandwiching (inserting or disposing) the first core 10 and the second core 20 therebetween. At the same time, the pair of outer wall parts 40 and 50 are respectively and vertically erected. Further, the metal terminal member 70 is provided at each of the pair of outer wall parts 40 and 50.

Figure 9:
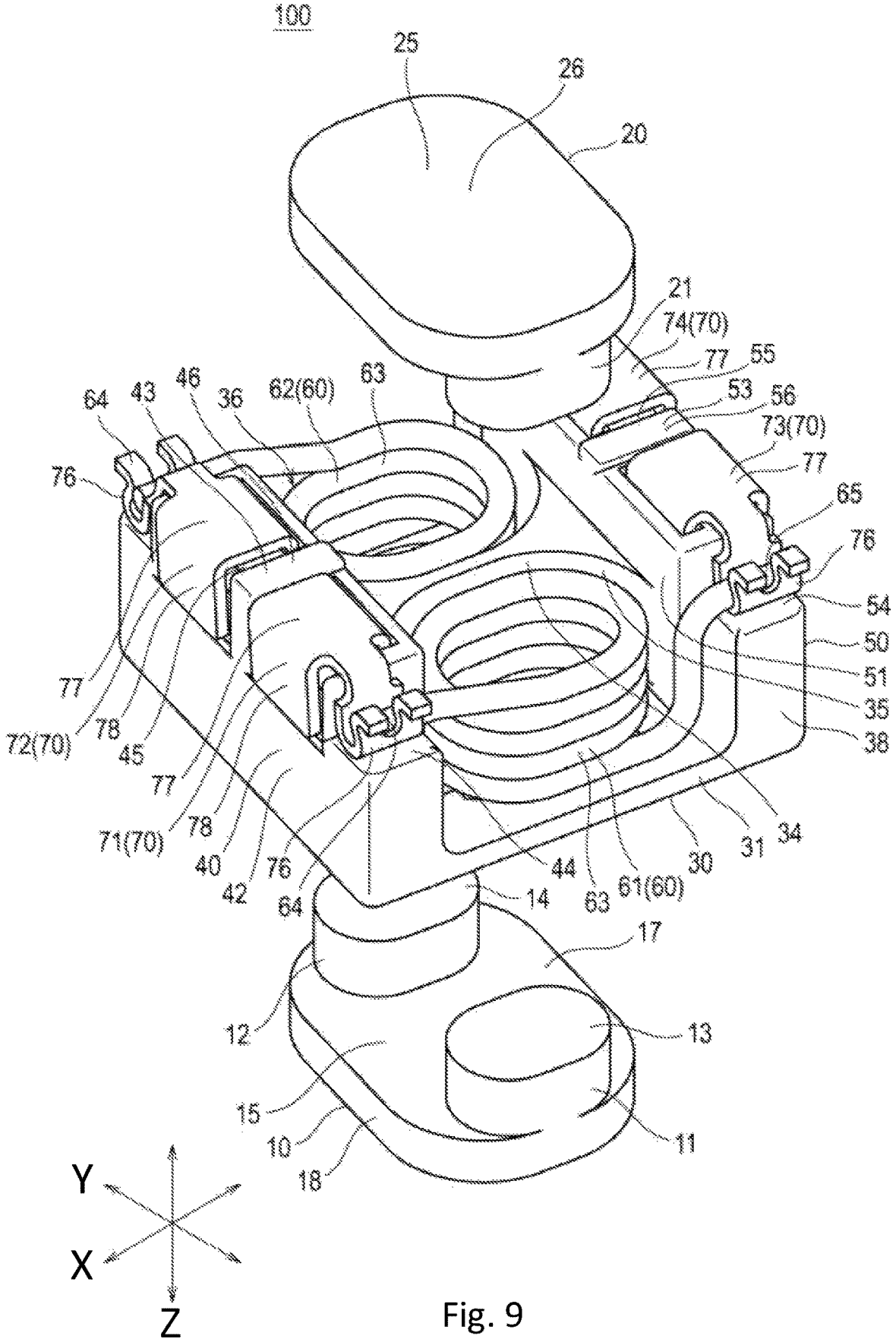
FIG. 9 is an exploded perspective view that shows the coil component when viewed from the side of a bottom surface of the coil component according to the embodiments of the present invention.

An entirety of the first core 10 is integrally formed with a magnetic material. In other words, the first core 10 is a monolithic core that is made of a magnetic material. As shown in FIGS. 7 and 9, the first connection part 15 of the first core 10 is formed in a panel (disk or plate) shape. One surface 16 (see FIG. 7) and the other surface 17 (see FIG. 9) of the first connection part 15 are respectively formed to be flat and are provided in parallel with each other. The planar shape of the first connection part 15 is not particularly limited. However, for instance, the planar shape is an elliptic shape, an oval shape, or a round cornered rectangular shape (refer to FIG. 2).

The first shaft parts 11 and 12 are respectively formed in, for instance, an elliptic cylindrical shape, an oval cylindrical shape, or a round cornered prismatic shape (a round cornered square column shape). The first shaft parts 11 and 12 are respectively protruded from the positions that are spaced apart from each other on the other surface 17 of the first connection part 15. The axial directions of the first shaft parts 11 and 12 are provided in parallel with each other. At the same time, the axial directions are orthogonal to a plate surface of the first connection part 15. The protruded lengths (the lengths of the first shaft parts 11 and 12 in the axial direction) of the first shaft parts 11 and 12 from the other surface 17 are equal to each other. Further, as shown in FIG. 3, a distance (a thickness) between the one surface 16 and the other surface 17 of the first connection part 15 is smaller than a width (a minor axis of the ellipse) in the Y-direction of the first shaft parts 11 and 12. Further, an extending direction of a major axis of the first connection part 15 and an extending direction of the major axis of the first shaft parts 11 and 12 are orthogonal to each other.

As shown in FIGS. 3 and 9, an end surface 13 of the first shaft part 11 and an end surface 14 of the first shaft part 12 are respectively, for instance, formed to be flat. At the same time, the end surface 13 of the first shaft part 11 and the end surface 14 of the first shaft part 12 are respectively provided on the same plane. The end surfaces 13 and 14 are orthogonal to a Z-direction.

In the following explanations, the axis directions of the first shaft parts 11 and 12 are sometimes referred to as a vertical direction (up-and-down directions) or the Z-direction. With respect to the first connection part 15, the surface 16 faces upward and the surface 17 faces downward. The first shaft parts 11 and 12 are protruded downward from the first connection part 15. An arrangement direction of the first shaft parts 11 and 12 is sometimes referred to as a Y-direction. The Z-direction and the Y-direction are orthogonal to each other. Further, a direction that is orthogonal to the Z-direction and Y-direction is referred to as an X-direction.

The second core 20 is formed to be in the same shape as the first core 10 with the same material as the first core 10. That is, the second core 20 has the second connection part 25 that is the same as the first connection part 15, the second shaft parts 21 and 22 that are the same as the first shaft parts 11 and 12, and end surfaces 23 and 24 that are the same as the end surfaces 13 and 14.

The second core 20 is provided in the inverted attitude (is flipped upside down or is to-bottom inversion attitude) relative to the first core 10. That is, one surface 26 (see FIGS. 3 and 9) of the second connection part 25 faces downward and the other surface (see FIGS. 3 and 7) of the second connection part 25 faces upward. The second shaft parts 21 and 22 are protruded upward from the other surface 27.

As shown in FIG. 3, the end surface 13 of the one first shaft part 11 and the end surface 23 of the one second shaft part 21 are in contact with each other as the surface contact or come close to each other in parallel. Similarly, the end surface 14 of the other first shaft part 12 and the end surface 24 of the other second shaft part 22 are in contact with each other as the surface contact or come close to each other in parallel. The end surface 13 and the end surface 23 are, for instance, mutually adhered and fixed with an adhesive. Similarly, the end surface 14 and the end surface 24 are, for instance, mutually adhered and fixed with the adhesive.

Figure 2:
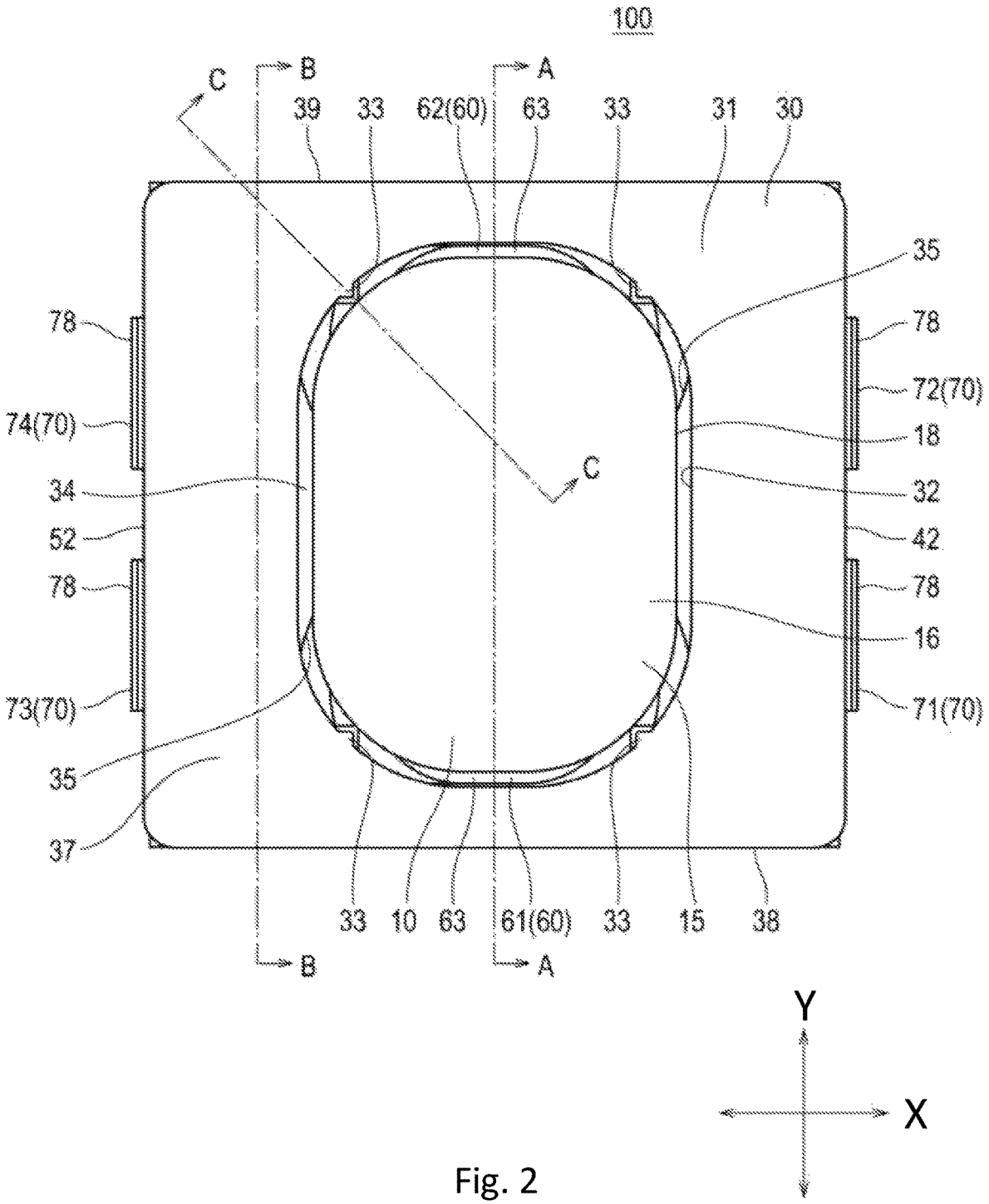
FIG. 2 is a plan view that shows the coil component according to the embodiments of the present invention.

The planar shape of the coil component 100 is not particularly limited. However, as shown in FIG. 2, the coil component 100 can be in a rectangular shape (for instance, a round cornered square shape). As shown in FIG. 1, the coil component 100 is, for instance, formed to be in a rectangular parallelepiped shape.

The case member 30 is configured by an insulating material such as a resin. An entire of the case member 30 is, for instance, integrally formed with the insulating material. In other words, the case member 100 is a monolithic case member that is made of an insulating material. The case member 30 has an upper surface 37, a front surface 38 (see FIGS. 2, 7, and 8), and a rear surface 39 (see FIGS. 2 and 9). Specifically, the surface 37 is flat in shape. The front surface 38 is one of outer surfaces in the Y-direction of the case member 30. The rear surface 39 is the other of the outer surfaces in the Y-direction of the case member 30. The upper surface 37 is one of the outer surfaces in the Z-direction of the case member 30. The outline of the upper surface 37 is in the rectangular shape (for instance, the round cornered square shape) (see FIG. 2). The front surface 38 and the rear surface 39 are formed to be in a U-shape that is opened downward, i.e., in an inverted U-shape. The front surface 38 and the rear surface 39 are provided in parallel with each other. Each of the front surface 38 and the rear surface 39 is orthogonal to the upper surface 37.

Further, the case member 30 has a first outer surface 42 and a second outer surface 52 that are a pair of outer surfaces in the X-direction. The first outer surface 42 is an outer surface of the outer wall part 40 (one of the outer walls 40 and 50) in the X-direction and the second outer surface 52 is an outer surface of the outer wall part 50 (the other of the outer walls 40 and 50) in the X-direction. The first outer surface 42 and the second outer surface 52 are provided in parallel with each other. The first outer surface 42 and the second outer surface 52 are orthogonal to the front surface 38 and the rear surface 39. At the same time, the first outer surface 42 and the second outer surface 52 are also orthogonal to the upper surface 37.

Further, the case member 39 has a lower surface that is another outer surface of the case member 30 in the Z-direction. The lower surface of the case member 30 is the aggregate of a lower surface 43 (see FIGS. 3 and 8) of the outer wall part 40 (one of the outer wall parts) and a lower surface 53 (see FIG. 8) of the outer wall part 50 (the other of the outer wall parts). The lower surfaces (the lower surfaces 43 and 53) of the case member 30 are provided in parallel relative to the upper surface 37.

Figure 8:
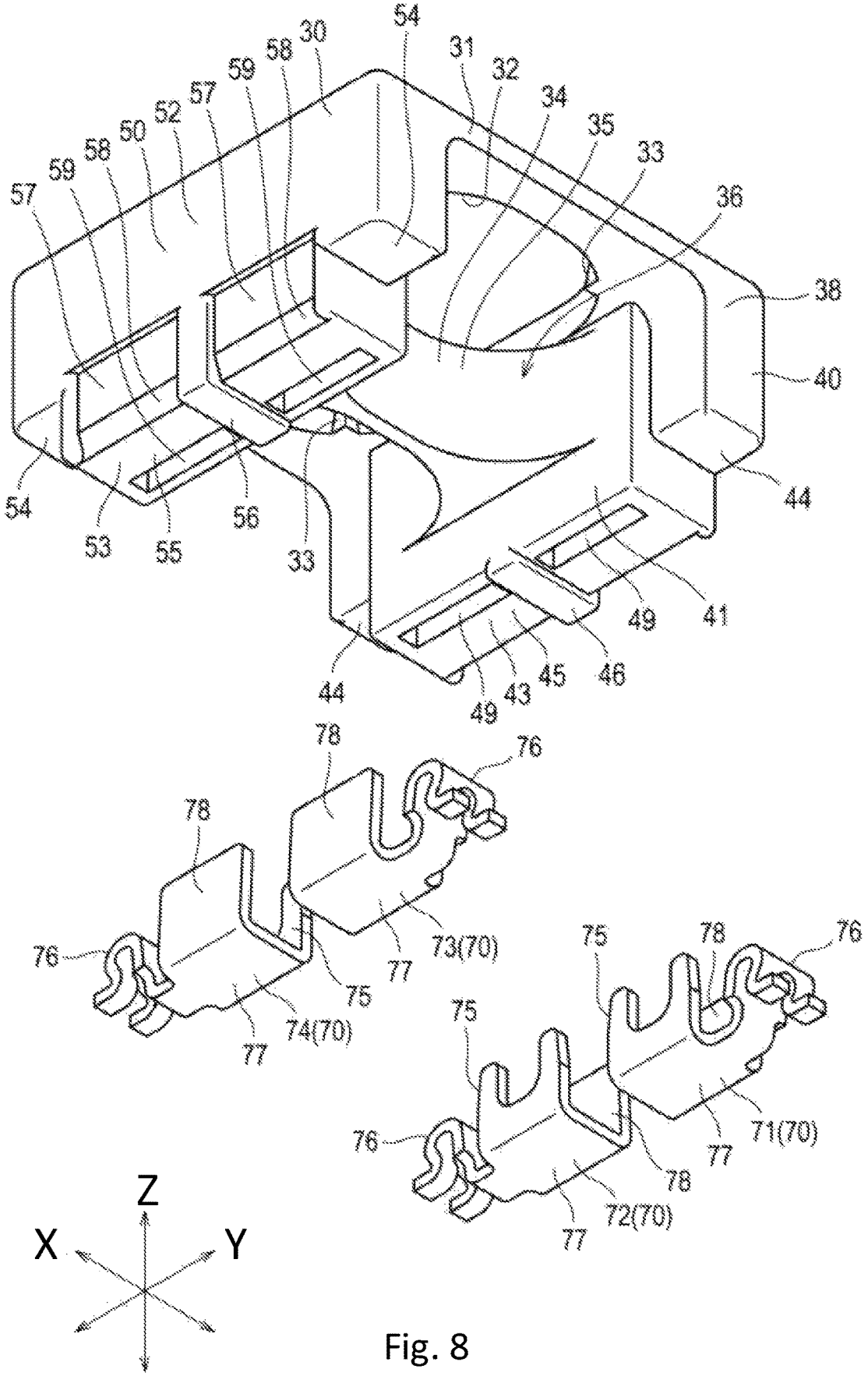
FIG. 8 is an exploded perspective view that shows a case member and metal terminal members of the coil component when viewed from the side of a lower surface of the case member according to the embodiments of the present invention.

Here, as shown in FIGS. 7 and 8, the case member 30 has a core holding part (core retainer) 31 that holds the first connection part 15 (the first opposed part) of the first core 10. Each of the pair of outer wall parts 40 and 50 is protruded downward from the core holding part 31. Each of the pair of outer wall parts 40 and 50 is, for instance, formed to be in a substantially rectangular parallelepiped shape having a longitudinal side in the Y-direction. It is preferred that the lower surfaces 43 and 53 of the outer wall parts 40 and 50 are located lower than the end surfaces 13 and 14 of the first shaft parts 11 and 12 of the first core 10. Further, it is more preferred that the lower surfaces 43 and 53 are located lower than the lower end of a winding section 63 (described below) of the coil 60. It is much more preferred that the lower surfaces 43 and 53 are located lower than the lower end of the coil 60. Further, it is specifically preferred that the lower surfaces 43 and 53 are located lower than the one surface 26 of the second connection part 25 of the second core 20.

As shown in FIG. 7, the core holding part 31 is formed in the panel shape orthogonal to the vertical direction. An opening (through hole) 32 that vertically penetrates through the core holding part 31 is formed at a center of the core holding part 31. The shape of the opening 32 is, for instance, formed to be in a shape that corresponds to the first connection part 15. The opening 32 has a size larger than a periphery of the first connection part 15 in a plan view (see FIG. 2).

Protrusions 33 are protruded toward the inside of the opening 32 and are formed at a plurality of places of an inner circumference surface of the opening 32. For instance, the protrusions 33 are provided at four corners of the opening 32. The inner circumference surface of the opening 32 is, for instance, parallel relative to the vertical direction (the Z-direction shown in FIG. 7). On the other hand, with respect to the protrusions 33, the protrusion amount from the inner circumference surface of the opening 32 increases downwardly. Specifically, each of the protrusions 33 is, for instance, in a triangular pyramid trapezoidal shape. Further, a horizontal cross-sectional area of each of the protrusions 33 increase downwardly. Each of the protrusions 33 is, for instance, formed from the upper end to the lower end of the opening 32.

Because the first connection part 15 of the first core 10 is pushed down into the opening 32 from the upper side of the case member 30, the first connection part 15 (the first opposed part) is press-fit into the core holding part 31. That is, the first connection part 15 is fixed to the core holding part 31 in the state in which an outer circumference surface 18 of the first connection part 15 is pressed in touch (contact) with each inclined plane of each of the protrusions 33 (refer to FIG. 5).

As explained above, the first core 10 is supported by the case member 30. Further, as explained above, the second core 20 is adhered and fixed to the first core 10. Thus, the second core 20 is indirectly supported by the case member 30 via the first core 10.

Figure 5:
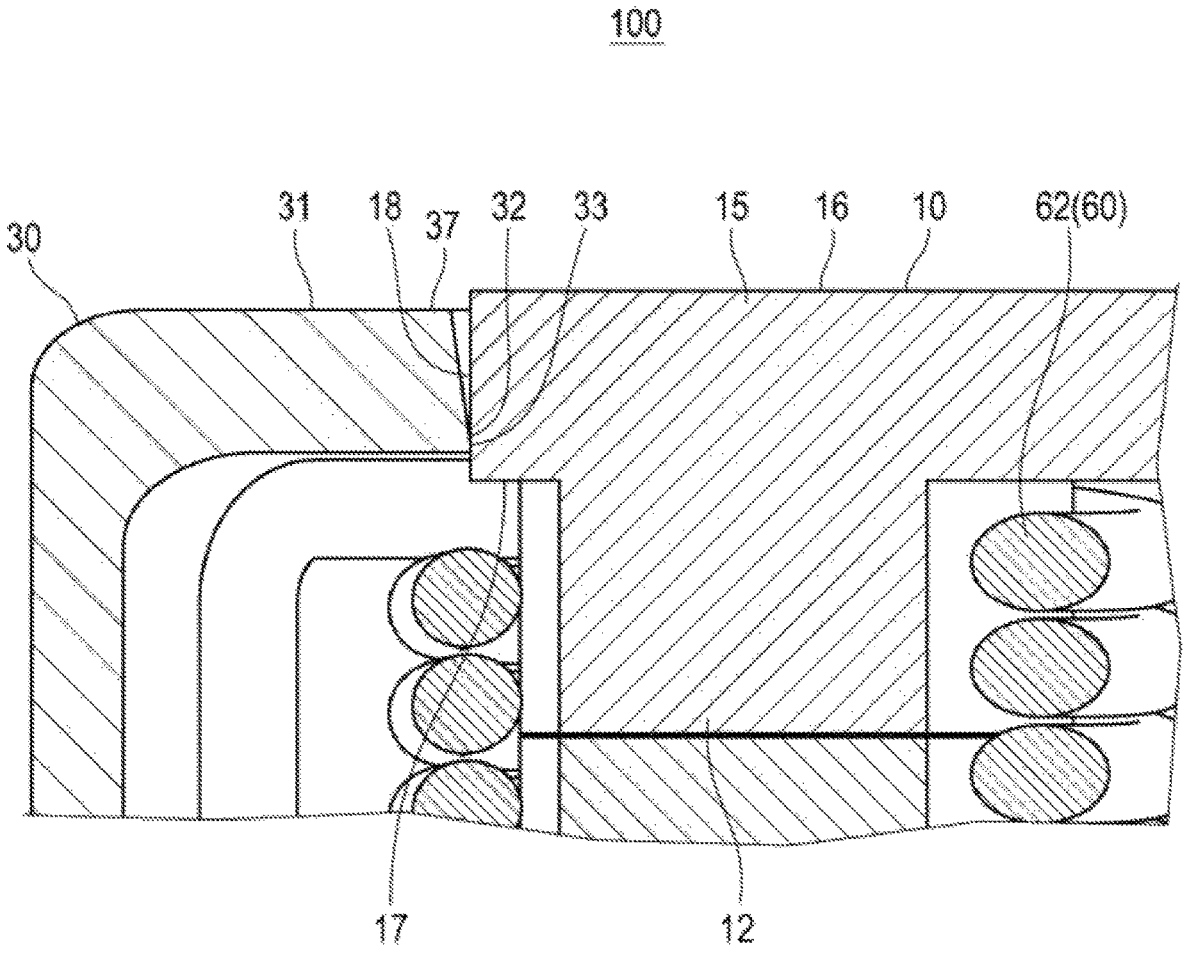
FIG. 5 is a cross-sectional view along the line C-C shown in FIG. 2 according to the embodiments of the present invention.

In the example shown in FIG. 5, a thickness dimension of the first connection part 15 is larger than a vertical dimension of the opening 32. The surface 16 of the first connection part 15 is located above the upper surface 37. At the same time, the other surface 17 of the first connection part 15 is located lower than the lower surface of the core holding part 31. That is, the first connection part 15 of the first core 10 is slightly protruded above the upper surface 37 of the case member 30. However, the relationship between the vertical dimension of the opening 32 (the thickness dimension of the core holding part 31) and the thickness dimension of the first connection part 15 is not particularly limited. For instance, the surface 16 and the upper surface 37 may be provided to be flush with each other. Alternatively, the surface 16 may be provided lower than the upper surface 37. Further, the other surface 17 may be provided to be flush with the lower surface of the core holding part 31. Alternatively, the other surface 17 may be provided above the lower surface of the core holding part 31.

Here, with respect to an inside of the case member 30, a space between the outer wall part 40 and the other outer wall part 50 and a space inside of the opening 32 correspond to the housing member (housing space or storage space) 36 in which the first core 10 and the second core 20 are stored.

As shown in FIG. 7, the coil component 100 has a first coil 61 and a second coil 62 as the coils 60. The first coil 61 is configured by using a metal wire that is made from a metallic material. The first coil 61 is configured with a winding section 63, one end 64, and the other end 65. Specifically, the winding section 63 is formed by spirally winding the metal wire. The one end 64 and the other end 65 are respectively protruded from the winding section 63.

The one end 64 is tangentially protruded from one end of the winding section 63 in the axial direction. The other end 65 of the first coil 61 is tangentially protruded from the other end of the winding section 63 in the axial direction and is turned down toward the one end in the axial direction. Further, the other end 65 is tangentially protruded from the one end in the axial direction. A protruding direction of the one end 64 from the winding section 63 and a protruding direction of the other end 65 from the winding section 63 are approximately opposite to each other. The one end 64 and the other end 65 are mutually located on the approximately same straight line. The one end 64 and the other end 65 respectively extend along the X-direction.

The second coil 62 is formed to be in the same shape as the first coil 61 and is configured with the winding section 63, the one end 64, and the other end 65. In the present embodiment, as shown in FIGS. 7 and 9, the first coil 61 and the second coil 62 are formed to be in a symmetrical shape (a mirror symmetry) in the Y-direction. With respect to the metal wire that configures the first coil 61 and the second coil 62, it is preferred that a resin coat is applied and formed on an outer circumference surface of the metal wire. With respect to at least a part of each of the one end 64 and the other end 65, the metallic material of the metal wire is exposed from the resin coat. The one end 64 and the other end 65 are, for instance, respectively soldered to the metal terminal members 70 (the details are described below) so as to being electrically connected.

As shown in FIG. 3, the first shaft part 11 and the second shaft part 21 are inserted into the winding section 63 of the first coil 61. Similarly, the first shaft part 12 and the second shaft part 22 are inserted into the winding section 63 of the second coil 62. That is, the coil component 100 has the first coil 61 that is wound around one of the shaft parts and the second coil 62 that is wound around the other of the shaft parts as the coils 60. Further, the case member 30 has a partition wall part 34 (refer to FIGS. 3, 6, 7, 8, and 9) that partitions an area into an arrangement region for one of the shaft parts and (the winding section 63 of) the first coil 61 and an arrangement region for the other of the shaft parts and (the winding section 63 of) the second coil 62.

That is, the coil component 100 has the first coil 61 and the second coil 62 as the coils 60. Specifically, the first coil 61 is wound around the first shaft part 11 and the second shaft part 21. The second coil 62 is wound around the other first shaft part 12 and the other second shaft part 22. The case member 30 has the partition wall part 34 (refer to FIGS. 3, 6, 7, 8, and 9) that partitions an area into the arrangement region for the first shaft part 11, the second shaft part 21, and (the winding section 63 of) the first coil 61 and the arrangement region for the other first shaft part 12, the other second shaft part 22, and (the winding section 63 of) the second coil 62.

The partition wall part 34 is installed between the outer wall part 40 and the other outer wall part 50. As a result, the case member 30 is reinforced by the partition wall part 34 so that the structural strength of the case member 30 can be enhanced. For instance, the partition wall part 34 is provided at a position lower than the core holding part 31. However, a position (height) of the upper surface of the partition wall part 34 can be equal to a position (height) of the lower surface of the core holding part 31. With respect to the partition wall part 34, a surface facing the arrangement region for the first shaft part 11, the second shaft part 21, and (the winding section 63 of) the first coil 61 corresponds to a concave surface 35 along an outer periphery of the winding section 63 of the first coil 61. Similarly, with respect to the partition wall part 34, a surface facing the arrangement region for the other first shaft part 12, the other second shaft part 22, and (the winding section 63 of) the second coil 62 corresponds to the concave surface 35 along an outer periphery of the winding section 63 of the second coil 62.

Each of the upper and lower surfaces of the partition wall part 34 is a flat surface that is orthogonal to the Z-direction. The (other) surface 17 of the first connection part 15 of the first core 10 is parallel to the upper surface of the partition wall part 34, and at the same time, is contacted to or close to the upper surface of the partition wall part 34 (refer to FIG. 3). The (other) surface 27 of the second connection part 25 of the second core 20 is parallel to the lower surface of the partition wall part 34. The other surface 27 can be contacted to or close to the lower surface of the partition wall part 34. However, in the example shown in FIG. 3, the other surface 27 is provided at a position lower than the lower surface of the partition wall part 34 with a predetermined distance.

As shown in FIGS. 7 and 8, for instance, the coil component 100 has the metal terminal members 71, 72, 73, and 74 as the metal terminal members 70. Specifically, the metal terminal member 71 is electrically connected to one end 64 of the first coil 61. The metal terminal member 72 is electrically connected to one end 64 of the second coil 62. The metal terminal member 73 is electrically connected to the other end 65 of the first coil 61. Further, the metal terminal member 74 is electrically connected to the other end 65 of the second coil 62. Among these terminal members, two of the metal terminal members 71 and 72 are provided at the outer wall part 40. The other two of the metal terminal members 73 and 74 are provided at the other outer wall part 50. The metal terminal members 71 and 72 are arranged in a line in the Y-direction. The metal terminal members 73 and 74 are arranged in a line in the Y-direction. The metal terminal members 71 and 73 are arranged in a line in the X-direction. The metal terminal members 72 and 74 are arranged in a line in the X-direction.

Figure 6:
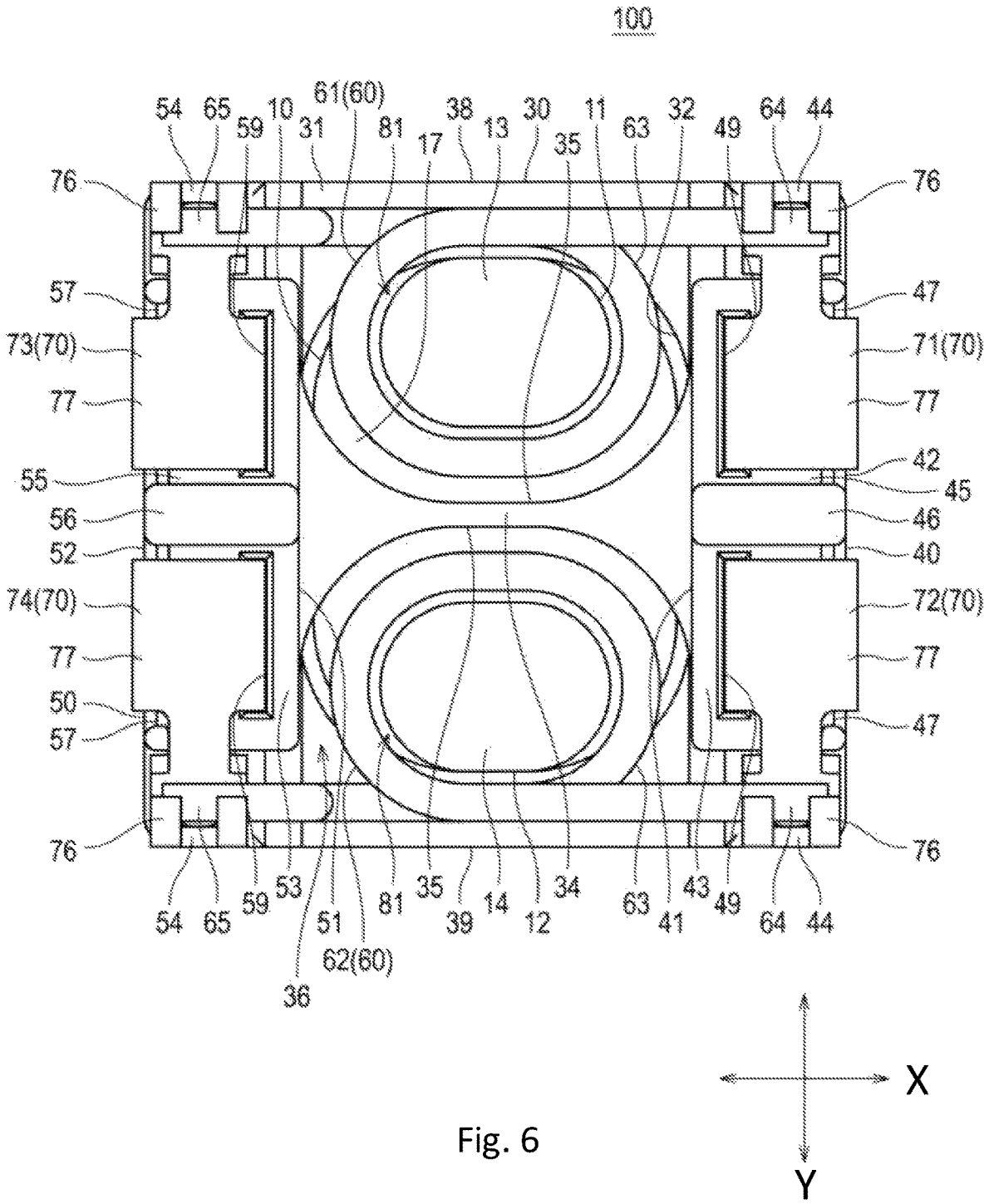
FIG. 6 is a bottom view that shows the coil component according to the embodiments of the present invention. However, an illustration of a second core is omitted from FIG. 6.

The outer wall part 40 of the pair of outer wall parts 40 and 50 has a first facing surface 41 (see FIGS. 6 and 8) that faces the other outer wall part 50. The other outer wall part 50 has a second facing surface 51 (see FIGS. 6, 7, and 9) that faces the outer wall part 40. As shown in FIG. 6, an entirety of the metal terminal members 70 (the metal terminal members 71 and 72) that are provided at the outer wall part 40 are provided at a position far away from the other outer wall part 50 as compared with (than) the first facing surface 41 (refer also to FIG. 9). In other words, the first facing surface 41 of the outer wall part 40 is located closer to the other outer wall part 50 than the metal terminal members 71 and 72 in a plan view. Similarly, as shown in FIGS. 6 and 9, an entirety of the metal terminal members 70 (the metal terminal members 73 and 74) that are provided at the other outer wall part 50 are provided at a position far away from the outer wall part 40 as compared with (than) the second facing surface 51. In other words, the second facing surface 51 of the other outer wall part 50 is located closer to the outer wall part 40 than the metal terminal members 73 and 74 in a plan view. As a result, because the configuration in which a part of the case member 30 is interposed between the metal terminal members 70 and the cores (the first core 10 and the second core 20) can be realized, the withstand voltage performance between the terminal (each of the metal terminal members 70) and the cores (the first core 10 and the second core 20) can be sufficiently ensured.

As shown in FIGS. 6 and 9, the one end(s) 64 of the coil(s) 60 is held by the metal terminal member(s) 70 that is provided at the outer wall part 40 of the pair of outer wall parts 40 and 50. That is, the one end 64 of the first coil 61 is held by the metal terminal member 71. Further, the one end 64 of the second coil 62 is held by the metal terminal member 72. Further, the other end(s) 65 of the coil(s) 60 is held by the metal terminal member(s) 70 that is provided at the other outer wall part 50 of the pair of outer wall parts 40 and 50. In other words, the other end 65 of the first coil 61 is held by the metal terminal member 73. Further, the other end 65 of the second coil 62 is held by the metal terminal member 74. As a result, the configuration in which the coil(s) 60 is installed between the pair of outer wall parts 40 and 50 is realized.

The coils 60 are in the non-contact state with the core member. That is, the coils 60 are not contacted with any of the first core 10 and the second core 20. Thus, the first coil 61 and the second coil 62 are not contacted with any of the first core 10 and the second core 20. As a result, the withstand voltage performance between the coils 60 and the cores (the first core 10 and the second core 20) can be sufficiently ensured. In addition, because of this configuration, the withstand voltage performance between the terminals (the metal terminal members 70) and the cores (the first core 10 and the second core 20) can be further sufficiently ensured. As shown in FIG. 3, a (air) gap 81 exists between the outer circumference surface of the first shaft part 11 of the first core 10 and the inner circumference surface of the winding section 63 of the first coil 61. Further, the (air) gap 81 exists between the outer circumference surface of the other second shaft part 21 of the second core 20 and the inner circumference surface of the winding section 63 of the first coil 61. Similarly, the (air) gap 81 exists between the outer circumference surface of the first shaft part 12 of the first core 10 and the inner circumference surface of the winding section 63 of the second coil 62. Further, the (air) gap 81 exists between the outer circumference surface of the other second shaft part 22 of the second core 20 and the inner circumference surface of the winding section 63 of the second coil 62.

More specifically, the coils 60 are in the non-contact state with the case member 30 (the coils 60 are not contacted to the any of the case member 30). That is, both ends of the coil 60 are held by the metal terminal members 70 that are provided at the case member 30 so that the coil 60 is installed between the metal terminal members 70.

As shown in FIG. 8, the metal terminal member 70 has an insertion part (insertion tab) 75, a coil end terminal (coil end) holding part (coil end retainer) 76 (refer to FIG. 9), and a terminal part (terminal pad) 77 (refer to FIG. 9). Specifically, the insertion part 75 is inserted and fixed to the outer wall parts 40 and 50. The coil end holding part 76 holds the ends of the coil 60 (one end 64 and the other end 65) in a conduction state. Further, the terminal parts 77 are provided on the lower surfaces 43 and 53 of the outer wall parts 40 and 50. As a result, the insertion parts 75 can be easily fixed to the outer wall parts 40 and 50 by inserting and fixing. The ends of the coil 60 can be held by the coil end holding parts 76 in the conduction state. Further, the coil component 100 can be mounted on such as a substrate by using the terminal parts 77 that are provided on the lower surfaces 43 and 53 of the outer wall parts 40 and 50.

Each of the metal terminal members 70 is configured by, for instance, bending a metal plate. For instance, the terminal part 77 is formed in a flat plate shape. The shape of the terminal part 77 is not particularly limited. However, for instance, the terminal part 77 is formed to be in a rectangular shape. The terminal part 77 of the metal terminal member 71 and the terminal part 77 of the metal terminal member 72 are provided along the lower surface 43 of a terminal arrangement part (terminal guide) 45 of the outer wall part 40. The terminal part 77 of the metal terminal member 73 and the terminal part 77 of the metal terminal member 74 are provided along the lower surface 53 of a terminal arrangement part (terminal guide) 55 of the other outer wall part 50. For instance, the insertion part 75 is formed in a flat plate shape. The shape of the insertion part 75 is not particularly limited. However, for instance, the insertion part 75 is formed to be in a shape in which a tip part is branched into two parts. That is, the insertion part 75 is in a U-shape (U-shaped). The insertion part 75 is, for instance, bent perpendicularly with respect to the terminal part 77 and raises upward from one side (referred to as "a first side") of the terminal part 77. The coil end holding part 76 is protruded from a second side that is adjacent to the first side of the terminal part 77. The coil end holding part 76 is bent upward into a convex bending shape (a Ω-shape). In addition, with respect to the coil end holding part 76, a part of a tip portion of the coil end holding part 76 in the protruding direction from the terminal part 77 is branched into two parts. The bending deformation capability of this part is good. The coil end holding part 76 is crimped (swaged) in a state in which the one end 64 or the other end 65 of the coil 60 are inserted in an inside of the part being the bending shape of the coil end holding part 76. As a result, the one end 64 or the other end 65 of the coil 60 is held by the coil end holding part 76. The terminal part 77 is located at a bottommost location among the parts (the insertion part 75 and coil end holding part 76) of the metal terminal members 70.

A pair of insertion holes 49 are formed at the terminal arrangement part 45 of the outer wall part 40. Each of the pair of insertion holes 49 has an opening end on the lower surface 43. These insertion holes 49 are located in a line in the Y-direction. The insertion hole 49 are formed to be relatively large in size in the Y-direction and the Z-direction and is formed to be relatively small in size in the X-direction. The insertion part 75 of the metal terminal member 71 is inserted and fixed to the one insertion hole 49. The insertion part 75 of the metal terminal member 72 is inserted and fixed to the other insertion hole 49. Similarly, a pair of insertion holes 59 are formed at the terminal arrangement part 55 of the other outer wall part 50. Each of the pair of insertion holes 59 has an opening end on the lower surface 53. These insertion holes 59 are located in a line in the Y-direction. The insertion hole 59 is formed to be relatively large in size in the Y-direction and the Z-direction and is formed to be relatively small in size in the X-direction. The insertion part 75 of the metal terminal member 73 is inserted and fixed to the one insertion hole 59. The insertion part 75 of the metal terminal member 74 is inserted and fixed to the other insertion hole 59.

Figure 4:
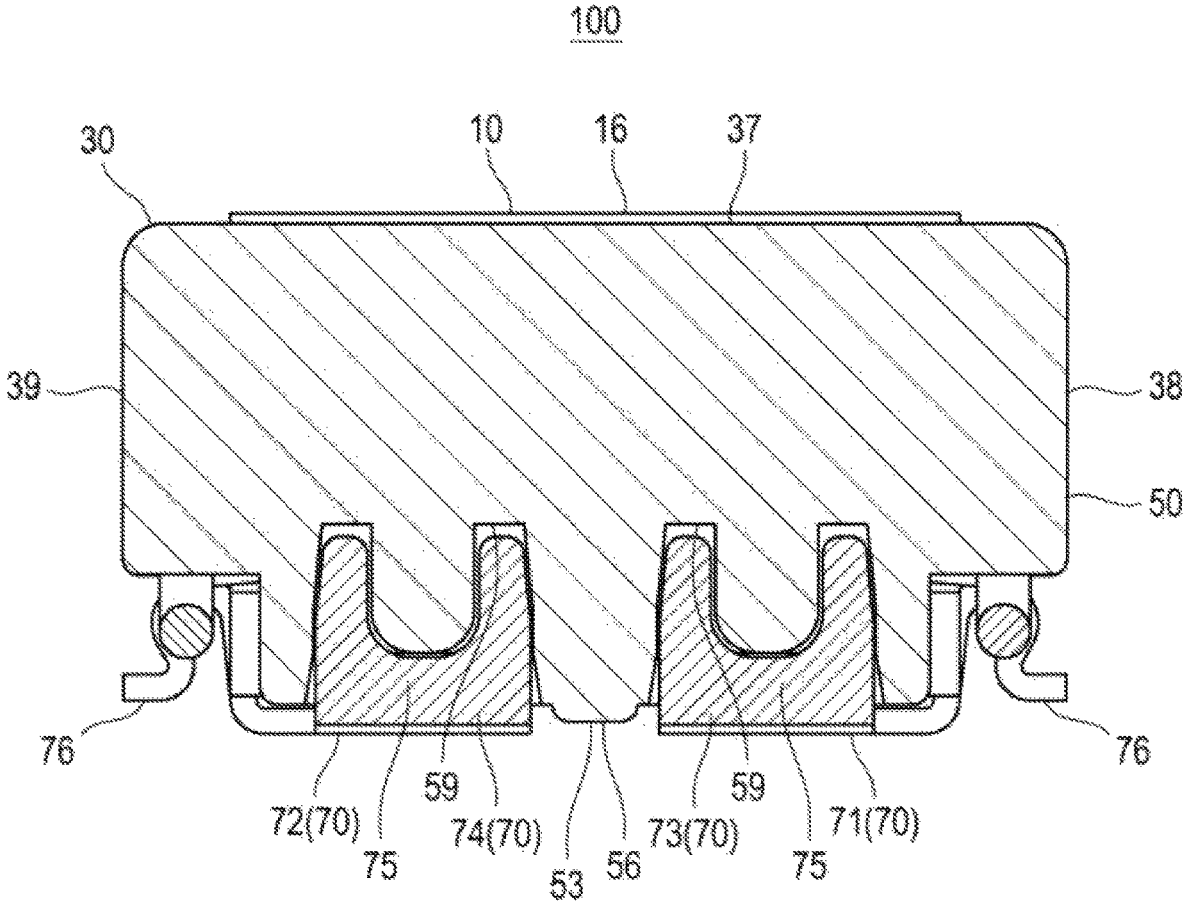
FIG. 4 is a cross-sectional view along the line B-B shown in FIG. 2 according to the embodiments of the present invention.

Further, as shown in FIG. 4, since the insertion hole 59 is formed to be in the U-shape that corresponds to the insertion part 75 being in the U-shape, the insertion part 75 is pressed into an inner surface of the insertion hole 59 with a sufficient adhesion. Similarly, although an illustration is omitted from the drawings, the insertion hole 49 is also formed to be in the U-shape that corresponds to the insertion part 75. Thus, the insertion part 75 is pressed into an inner surface of the insertion hole 49 with a sufficient adhesion. Further, in addition to the example in which the metal terminal member 70 is pressed into the case member 30, for instance, these two members may be integrally formed by using various technologies such as an insert molding technology.

In addition, the metal terminal member 70 has an opposed part 78. For instance, the opposed part 78 is formed in a flat plate shape. The shape of the opposed part 78 is not particularly limited. However, for instance, the opposed part 78 is formed to be in a rectangular shape. The opposed part 78 raises upward from a third side (the side being adjacent to a second side) that is opposed to the first side of the terminal part 77. Therefore, the opposed part 78 and the insertion part 75 inwardly face to each other. The opposed part 78 of the metal terminal member 71 and the opposed part 78 of the metal terminal member 72 are located along the portion being adjacent to the lower surface 43 on the first outer surface 42 of the outer wall part 40. More specifically, a pair of shallow recessed parts 47 (FIG. 7) are formed at the portion being adjacent to the lower surface 43 on the first outer surface 42. The pair of recessed parts 47 are located in a line in the Y-direction. The opposed part 78 of the metal terminal member 71 is provided at one of the recessed parts 47. The opposed part 78 of the metal terminal member 72 is provided at the other of the recessed parts 47. The opposed part 78 of the metal terminal member 73 and the opposed part 78 of the metal terminal member 74 are provided along the portion being adjacent to the lower surface 53 on the second outer surface 52 of the other outer wall part 50. More specifically, a pair of shallow recessed parts 57 (FIG. 8) are formed at the portion being adjacent to the lower surface 53 on the second outer surface 52. The pair of recessed parts 57 are provided in a line in the Y-direction. The opposed part 78 of the metal terminal member 73 is provided at one of the recessed parts 57. The opposed part 78 of the metal terminal member 74 is provided at the other of the recessed parts 57.

Further, for instance, a partition step 46 is formed from the lower surface 43 through the first outer surface 42 at the terminal arrangement part 45. The partition step 46 is formed to have a higher step downward than the other part on the lower surface 43. The partition step 46 is formed to be flush with the part other than the recessed part 47 on the first outer surface 42 (i.e., the partition step 46 is formed to have a higher step than the recessed part 47). The partition step 46 partitions the arrangement area of the metal terminal member 71 from the arrangement area of the metal terminal 72 (refer to FIG. 9). Similarly, for instance, a partition step 56 is formed from the lower surface 53 through the second outer surface 52 at the terminal arrangement part 55. The partition step 56 is formed to have a higher step downward than the other part on the lower surface 53. The partition step 56 is formed to be flush with the part other than the recessed part 57 on the second outer surface 52 (i.e., the partition step 56 is formed to have a higher step than the recessed part 57). The partition step 56 partitions the arrangement area of the metal terminal member 73 from the arrangement area of the metal terminal 74.

A tilted surface 48 is respectively formed between each of the recessed parts 47 and the lower surface 43. Similarly, a tilted surface 58 is respectively formed between each of the recessed parts 57 and the lower surface 53. As a result, the opposed part 78 and the terminal part 77 of the metal terminal member 70 can be easily arranged along the recessed part 47 and the lower surface 43. At the same time, the opposed part 78 and the terminal part 77 of the metal terminal member 70 can be easily arranged along the recessed part 57 and the lower surface 53. A tilt angle of the tilted surface 58 is, for instance, greater than 45 degrees. That is, an angle formed by the lower surface 53 and the tilted surface 58 is greater than an angle formed by the recessed part 57 and the tilted surface 58. Similarly, a tilt angle of the tilted surface 48 is, for instance, greater than 45 degrees.

Lower surface side recessed parts 44 and 54 are formed at the lower surfaces 43 and 53 of the outer wall parts 40 and 50, respectively. Specifically, the lower surface side recessed parts 44 and 54 are hollowed toward the upper surfaces of the outer wall parts 40 and 50, respectively. The coil end holding parts 76 are provided at the lower surface side recessed parts 44 and 54. As a result, when the coil component 100 is mounted on such as a substrate, an interference between the coil end holding part 76 and the substrate can be suppressed. More specifically, a lower end position of the coil end holding part 76 is located higher the lower surfaces 43 and 53 (refer to FIG. 4). As a result, the interference between the coil end holding part 76 and such as the substrate can be more certainly suppressed.

As shown in FIG. 8, the outer wall part 40 has the pair of lower surface side recessed parts 44 and the terminal arrangement part 45 on which the terminal part 77 is arranged (refer to FIG. 9). Specifically, the terminal arrangement part 45 is provided between these lower surface side recessed parts 44. In a direction (the Y-direction shown in FIG. 9) parallel to the arrangement direction of the arrangement area of one of the shaft parts and the arrangement area of the other of the shaft parts, one of the pair of lower surface side recessed parts 44, the terminal arrangement part 45, and the other of the pair of lower surface side recessed parts 44 are arranged in a line (aligned) in this order. That is, in the direction (the Y-direction shown in FIG. 9) parallel to the arrangement direction of the arrangement area of the first shaft part 11 and the second shaft part 21 and the arrangement area of the other first shaft part 12 and the other second shaft part 22, one of the pair of lower surface side recessed parts 44, the terminal arrangement part 45, and the other of the pair of lower surface side recessed parts 44 are arranged in a line (aligned) in this order.

Similarly, the outer wall part 50 has the pair of lower surface side recessed parts 54 and the terminal arrangement part 55 on which the terminal part 77 is arranged (refer to FIG. 9). Specifically, the terminal arrangement part 55 is provided between these lower surface side recessed parts 54. In a direction (the Y-direction shown in FIG. 9) parallel to the arrangement direction of the arrangement area of one of the shaft parts and the arrangement area of the other of the shaft parts, one of the pair of lower surface side recessed parts 54, the terminal arrangement part 55, and the other of the pair of lower surface side recessed parts 54 are arranged in a line (aligned) in this order. That is, in the direction (the Y-direction shown in FIG. 9) parallel to the arrangement direction of the arrangement area of the first shaft part 11 and the second shaft part 21 and the arrangement area of the other first shaft part 12 and the other second shaft part 22, one of the pair of lower surface side recessed parts 54, the terminal arrangement part 55, and the other of the pair of lower surface side recessed parts 54 are arranged in a line (aligned) in this order.

The coil end holding part 76 of the metal terminal member 71 is provided at one of the lower surface side recessed parts 44. The coil end holding part 76 of the metal terminal member 72 is provided at the other of the lower surface side recessed parts 44. Similarly, the coil end holding part 76 of the metal terminal member 73 is provided at one of the lower surface side recessed parts 54. The coil end holding part 76 of the metal terminal member 74 is provided at the other of the lower surface side recessed parts 54.

More specifically, in the direction (the Y-direction shown in FIG. 9) parallel to the arrangement direction of the arrangement area of the first shaft part 11 and the second shaft part 21 and the arrangement area of the other first shaft part 12 and the other second shaft part 22, the pair of lower surface side recessed parts 44 are provided at the (opposite) ends of the outer wall part 40. Further, each of the lower surface side recessed parts 44 opens toward a side being opposite to the terminal arrangement part 45 in the Y-direction and also opens downward, and in addition, opens to the both sides in the X-direction that is orthogonal to the vertical direction and the Y-direction.

Similarly, the pair of lower surface side recessed parts 54 are provided at the (opposite) ends of the outer wall part 50 in the Y-direction. Further, each of the lower surface side recessed parts 54 opens to the side being opposite to the terminal arrangement part 55 in the Y-direction and also opens downward, and in addition, opens to the both sides in the X-direction that is orthogonal to the vertical direction and the Y-direction.

As a result, the work for connecting the ends (the one end 64 and the other end 65) of the coil 60 to the coil end holding parts 76 can be easily performed. For instance, each of the lower surface side recessed parts 44 and each of the lower surface side recessed parts 54 is in a substantially rectangular parallelepiped shape.

Further, the coil component 100 has no bobbin. The winding section 63 of the first coil 61 is wound around the first shaft part 11 of the first core 10 and the second shaft part 21 of the second core 20 in a state in which the winding section 63 of the first coil 61 does not contact with the first shaft part 11 and the second shaft part 21.

For instance, the assembly of the coil component 100 according to the embodiments of the present invention can be performed as explained below.

First, the insertion part 75 of each of the metal terminal members 70 is press-fit to the case member 30 by respectively inserting into the corresponding insertion hole 49 or hole 59 so that each of the metal terminal members 70 is attached to the case member 30. Further, the metal terminal member 70 may be attached to the case member 30 with an adhesive.

Next, as shown in FIG. 7, the first coil 61 and the second coil 62 are formed in advance to be in the shape having the winding sections 63, the one end 64 and the other end 65. The ends 64 and 65 of the coils 61 and 62 are crimped (swaged) and fixed to the corresponding coil end holding parts 76 of the metal terminal members 70. That is, the one end 64 of the first coil 61 is crimped (swaged) and fixed to the coil end holding part 76 of the metal terminal member 71. The other end 65 of the first coil 61 is crimped (swaged) and fixed to the coil end holding part 76 of the metal terminal member 73. Further, the one end 64 of the second coil 62 is crimped (swaged) and fixed to the coil end holding part 76 of the metal terminal member 72. The other end 65 of the second coil 62 is crimped (swaged) and fixed to the coil end holding part 76 of the metal terminal member 74. The winding section 63 of the first coil 61 and the winding section 63 of the second coil 62 are provided within the housing member 36, and at the same time, the winding section 63 of the first coil 61 and the winding section 63 of the second coil 62 are isolated from each other by the partition wall part 34.

Thereafter, from the upper side of the case member 30, the first shaft part 11 of the first core 10 is inserted into the winding section 63 of the first coil 61, and at the same time, the first shaft part 12 of the first core 10 is inserted into the winding section 63 of the second coil 62 so that the first connection part 15 of the first core 10 is press-fit into the opening 32 of the core holding part 31. Further, from the lower side of the case member 30, the second shaft part 21 of the second core 20 is inserted into the winding section 63 of the first coil 61, and at the same time, the other second shaft part 22 of the second core 20 is inserted into the winding section 63 of the second coil 62. Further, the end surface 13 of the first shaft part 11 and the end surface 23 of the second shaft part 21 are mutually fixed with an adhesive, and at the same time, the end surface 14 of the first shaft part 12 and the end surface 24 of the second shaft part 22 are mutually fixed with the adhesive. As a result of the above describe assembly, the coil component 100 can be obtained. Further, the coil component 100 may have a mold resin that encloses the coil component 100. However, a detailed illustration of the mold resin is omitted.

Variation

Next, a coil component 100 according to a variation of the embodiments of the present invention will be explained with reference to FIGS. 10A-10B and 11A-11B. The coil component 100 according to the variation of the embodiments of the present invention is different from the coil component 100 according to the embodiments of the present invention with respect to an aspect (configuration) being explained below. With respect to the other aspects (configurations), the coil component 100 according to the variation of the embodiments of the present invention is configured in the same way as the coil component 100 according to the embodiments of the present invention being explained above.

Figure 10A:
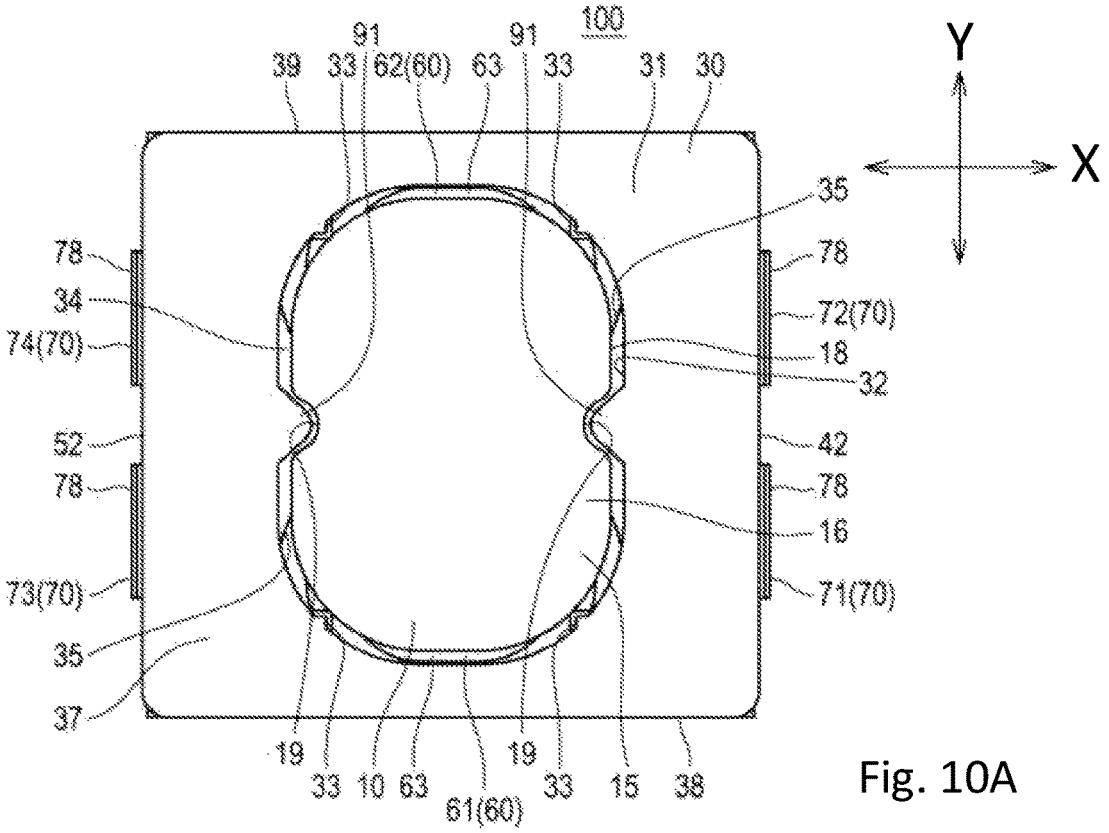
FIG. 10A is a plan view that shows a coil component according to a variation of the embodiments of the present invention.
Figure 11B:
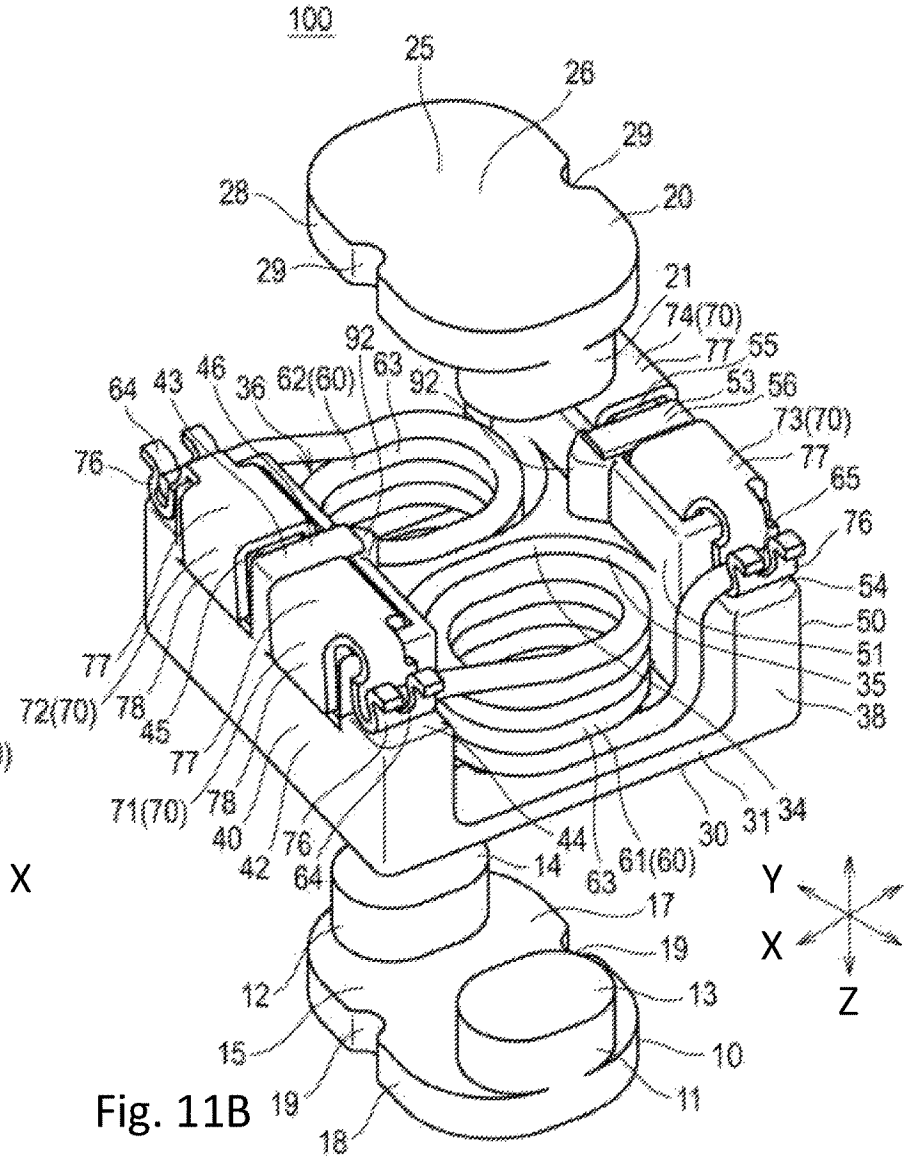
FIG. 11B is an exploded perspective view that shows the coil component when viewed from the side of a lower surface according to the variation of the embodiments of the present invention.
Figure 11A:
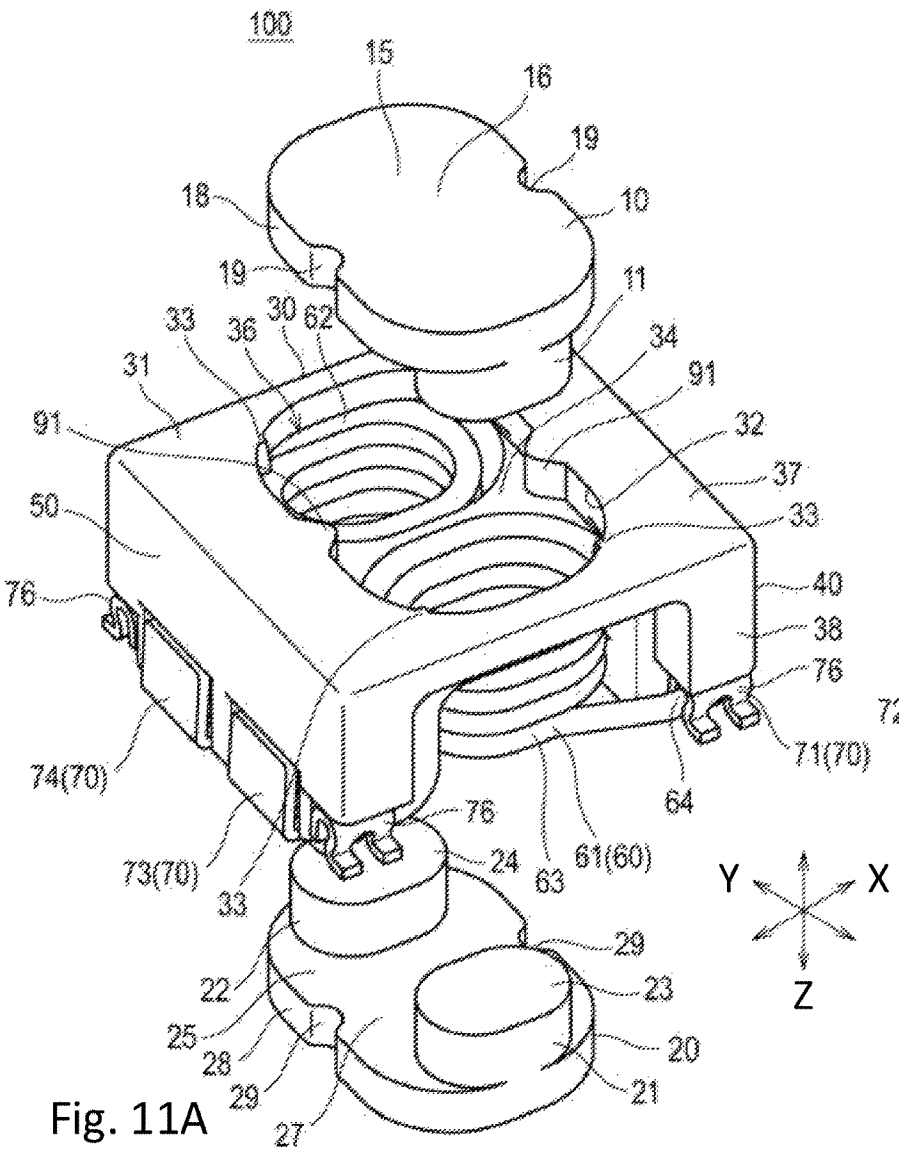
FIG. 11A is an exploded perspective view that shows the coil component when viewed from the side of an upper surface according to the variation of the embodiments of the present invention.

In the variation of the embodiments, as shown in FIGS. 10A and 11A, a pair of protrusions 91 (a convex part) are formed at the inner circumference surface of the opening 32 of the case member 30 in addition to protrusions 33 at the four corners. The protrusions 91 are inwardly projected toward a center of the opening 32 in a plan view. That is, the case member 30 has the pair of protrusions 91. These protrusions 91 are provided at a center of the opening 32 in the Y-direction. One of the protrusions 91 is protruded from the inner circumference surface of the opening 32 to one direction along the X-direction. The other of the protrusions 91 is protruded from the inner circumference surface of the opening 32 to an opposite direction along the X-direction.

A planer shape of each of the protrusions 91 is in a substantially triangle shape (in the plan view). Widths of each of the protrusions 91 become gradually narrower toward an apex (an inner side of the opening 32) in the protruding direction of the protrusion 91. The apex (a tip part of the protrusion 91 in the protruding direction) of the protrusion 91 is rounded (in a round shape).

An upper surface of each of the protrusions 91 is, for instance, a flat and horizontal surface that is flush with the upper surface 37 of the case member 30. The protrusions 91 are provided above (or on) the upper surface of the partition wall part 34. The lower ends of the protrusions 91 reach the upper surface of the partition wall part 34.

A pair of recessed parts 19 that correspond to each of the protrusions 91 are formed on the outer circumference surface 18 (a side circumference surface) of the first connection part 15 of the first core 10. The recessed part 19 is provided at a position that corresponds to each of the protrusions 91. Each of recessed parts 19 is in a shape that corresponds to each of the protrusions 91 and is formed from the upper end through the lower end of the first connection part 15. That is, the planer shape of each of the recessed parts 19 is in a substantially triangle shape. The widths of the recessed parts 19 become gradually narrower downward along a depth direction. Further, the deepest part of the recessed part 19 is rounded (in a round shape).

Further, as shown in FIG. 10A, one of the protrusions 91 enters into one of the recessed parts 19, and at the same time, the other of the protrusions 91 enters into the other of the recessed parts 19 when the first connection part 15 of the first core 10 is held by the core holding part 31 of the case member 30. That is, the protrusion 91 and the recessed part 19 are fitted to each other. As a result, the position gap of the first core 10 relative to the case member 30 can be suppressed.

Figure 10B:
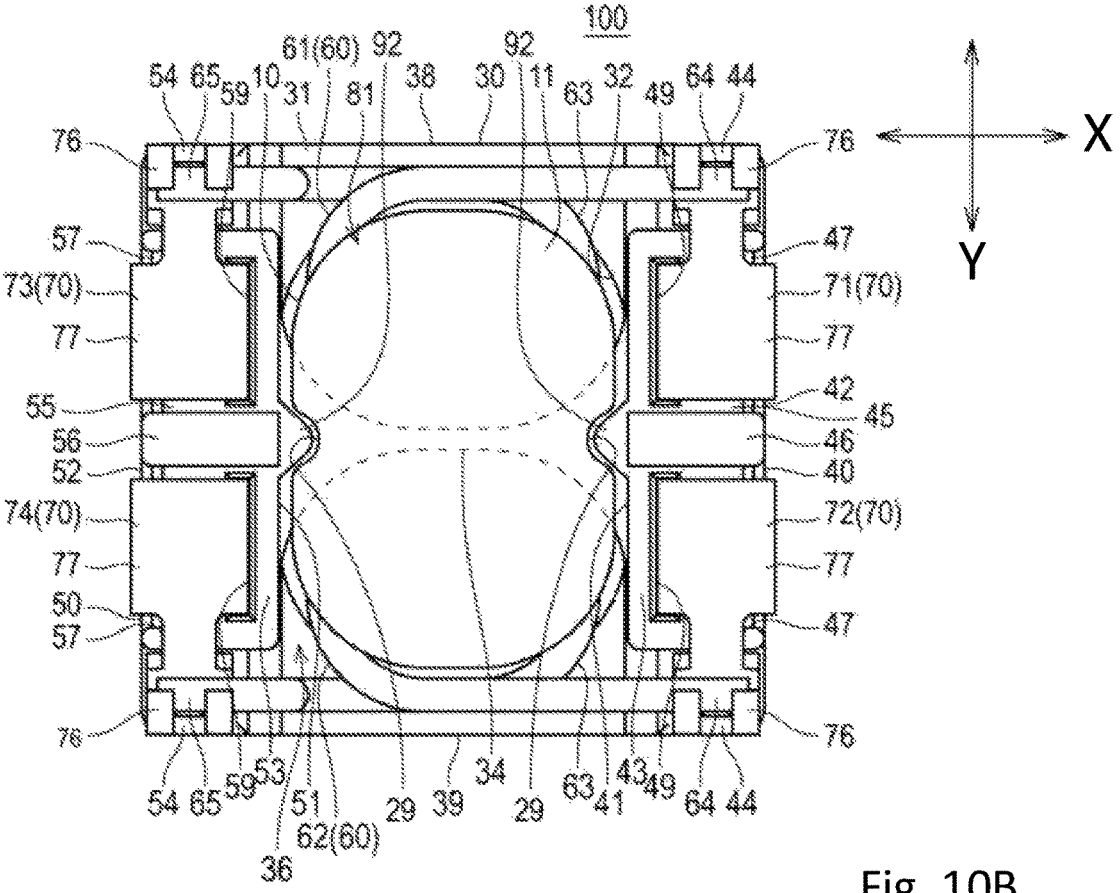
FIG. 10B is a bottom view that shows the coil component according to the variation of the embodiments of the present invention.

As shown in FIGS. 10B and 11B, a protrusion 92 (a convex part) is respectively formed on the first facing surface 41 of the outer wall part 40 and on the second facing surface 51 of the other outer wall part 50. That is, the case member 30 has a pair of protrusions 92. One of the protrusions 92 is protruded from the center in the Y-direction of the first facing surface 41 in one direction (on the side of the second facing surface 51) along the X-direction. The other of the protrusions 92 is protruded from the center in the Y-direction of the second facing surface 51 in the opposite direction (on the side of the first facing surface 41) along the X-direction.

A shape of the protrusion 92 is the same as the shape of the protrusion 91. That is, the planer shape of each of the protrusions 92 is in a substantially triangle shape. Widths of each of the protrusions 92 become gradually narrower toward an apex in the protruding direction of the protrusion 92. The apex (a tip part of the protrusion 92 in the protruding direction) of the protrusion 92 is rounded (in the round shape).

A lower surface of each of the protrusions 92 is, for instance, a flat and horizontal surface. The lower surface of one of the protrusions 92 is substantially flush with the lower surface 43 of the outer wall part 40. The lower surface of the other of the protrusions 92 is substantially flush with the lower surface 53 of the outer wall part 50. Each of the protrusions 92 is provided below the upper surface of the partition wall part 34. The upper ends of the protrusions 92 reach the lower surface of the partition wall part 34.

A pair of recessed parts 29 that correspond to each of the protrusions 92 are formed on the outer circumference surface 28 (a side circumference surface) of the second connection part 25 of the second core 20. The recessed part 29 is provided at a position that corresponds to each of the protrusions 92. The shape of the recessed part 29 is the same as the shape of the recessed part 19. That is, each of recessed parts 29 is in a shape that corresponds to each of the protrusions 92 and is formed from the upper end through the lower end of the second connection part 25. That is, the planer shape of each of the recessed parts 29 is in a substantially triangle shape. The widths of the recessed parts 29 become gradually narrower downward along a depth direction. Further, the deepest part of the recessed part 29 is rounded (in a round shape).

Further, when the second core 20 is fixed to the first core 10, as shown in FIG. 10B, one of the protrusions 92 enters into one of the recessed parts 29, and at the same time, the other of the protrusions 92 enters into the other of the recessed parts 29. That is, the protrusion 92 and the recessed part 29 are fitted to each other. As a result, the position gap of the second core 20 relative to the case member 30 can be suppressed.

Further, in the variation of the embodiments of the present embodiment, the examples in which the recessed parts 19 and 29 are respectively formed in the first connection part 15 and the second connection part 25 and the protrusions 91 and 92 in the case member 30 that are fitted into the recessed parts 19 and 29 are explained. However, the variation of the embodiments of present invention is not limited to these examples. The recessed parts that are formed in the case member 30 and the convex parts that are formed in the first connection part 15 and the second connection part 25 may be fitted to each other.

As explained above, as the coil component 100, the following configuration can be adopted. Specifically, the recessed part or the convex part that is formed in the first opposed part (the first connection part 15) and the convex part or the recessed part that is formed in the case member 30 are fitted to each other, and at the same time, the recessed part or the convex part that is formed is the second opposed part (the second connection part 25) and the convex part or the recessed part that is formed in the case member 30 are fitted to each other.

The coil component being thus described, it will be apparent that the same may be varied in many ways. For instance, in the embodiments, it is explained that the first core 10 and the second core 20 are the U-shaped cores. However, one (for instance, the second core 20) of the first core 10 and the second core 20 may be an I-shaped core that is in a plate shape, for example. In this case, one shaft part is configured by the first shaft part 11 of the first core 10 and the other shaft part is configured by the first shaft part 12 of the first core 10. Further, the second core 20 does not configure the shaft part.

The embodiments of the present invention include the following technical ideas or technical concepts.

<1> A coil component including:

a core member including:

first and second shafts being arranged in parallel; and first and second opposed members, the first opposed member spanning between one end of the first and second shafts, the second opposed member spanning between the other ends of the first and second shafts;

a case supporting the core member, the case being made of an insulating material, the case is configured with:

a housing member accommodating the core member; and first and second outer walls opposing each other, the core member being disposed between the first and second outer walls;

a coil wound around the first and second shafts; and first and second metal terminals being electrically connected to the coil, the first and second metal terminals being provided at the first and second outer walls, respectively, wherein the first and second opposed members are opposed to each other and sandwich the first and second shafts therebetween.

<2> The coil component according to <1>, wherein the first and second outer walls have first and second inner surfaces, respectively, and the first and second inner surfaces face each other, and the first and second metal terminals are entirely disposed at external locations of the first and second outer walls than the first and second inner surfaces, respectively.

<3> The coil component according to <1> or <2>, wherein the coil has first and second ends, the first end is held by the first metal terminal, and the second end is held by the second metal terminal.

<4> The coil component according to any one of <1>-<3>, wherein the coil and the core member are in a non-contact state.

<5> The coil component according to any one of <1>-<4>, wherein the coil and the case are in a non-contact state.

<6> The coil component according to any one of <1>-<5>, wherein each of the first and second terminals is configured with: an insertion part that is inserted into and fixed to every one of the first and second outer walls; a coil end holding part that conductively holds an end of the coil; and a terminal part that is disposed on a bottom surface of every one of the first and second outer walls.

<7> The coil component according to <6>, wherein each of the bottom surfaces of the first and second outer walls has a wall bottom recess, and the wall bottom recess is upwardly recessed, and the coil end holding part is disposed in the wall bottom recess.

<8> The coil component according to <7>, wherein the wall bottom recess is configured with first and second wall bottom recesses, each of the first and second outer walls has a terminal arrangement part, and the terminal arrangement part is sandwiched between the first and second wall bottom recesses, and an arrangement direction of the first and second shafts is in parallel with an arrangement direction of the first wall bottom recess, the terminal arrangement part, and the second wall bottom recess.

<9> The coil component according to any one of <1>-<8>, wherein the case further has a core holding member that holds the first opposed member of the core member, and the first and second outer walls downwardly project from the core holding member.

<10> The coil component according to <9>, wherein the first opposed member is press-fit to the core holding member.

<11> The coil component according to any one of <1>-<10>, wherein the coil is configured with first and second coils, the first coil is wound around the first shaft, and the second coil is wound around the second shaft, and the case further has a partition wall that separates a first region in which the first coil and the first shaft are disposed from a second region in which the second coil and the second shaft are disposed.

<12> The coil component according to any one of <1>-<11>, wherein a first concave or a first convex of the first opposed member fits a second convex or a second concave of the case, and a third concave or a third convex of the second opposed member fits a fourth convex or a fourth concave of the case.

<13> The coil component according to any one of <1>-<12>, wherein the core member is configured by first and second cores, the first core is configured with one part of the first shaft, the first opposed part, and one part of the second shaft, the second core is configured with the other part of the first shaft, the second opposed part, and the other part of the second shaft, the first opposed part is connected between the one part of the first shaft and the one part of the second shaft, and the second opposed part is connected between the other part of the first shaft and the other part of the second shaft, and the first core is fixed to the second core in an axial direction of the first and second shafts to form the core member.

Further, the embodiments of the present invention further include the following technical ideas or technical concepts.

(1) A coil component including:

a first core including a pair of first shafts being arranged in parallel and a first connection member connecting between the pair of first shafts;

a second core including a pair of second shafts being arranged in parallel and a second connection member connecting between the pair of second shafts;

a case supporting the first and second cores, the case being made of an insulating material, the case is configured with:

a housing member accommodating the first and second cores; and first and second outer walls opposing each other, the first and second cores being disposed between the first and second outer walls;

a coil wound around the first and second shafts; and first and second metal terminals being electrically connected to the coil, the first and second metal terminals being provided at the first and second outer walls, respectively, wherein the first and second connection members are opposed to each other and sandwich the pairs of first and second shafts therebetween, and one of the pair of first shafts and one of the pair of second shafts are coaxially arranged, and the other of the pair of first shafts and the other of the pair of second shafts are coaxially arranged.

(2) The coil component according to (1), wherein the first and second outer walls have first and second inner surfaces, respectively, and the first and second inner surfaces face each other, and the first and second metal terminals are entirely disposed at external locations of the first and second outer walls than the first and second inner surfaces, respectively.

(3) The coil component according to (1) or (2), wherein the coil has first and second ends, the first end is held by the first metal terminal, and the second end is held by the second metal terminal.

(4) The coil component according to any one of (1)-(3), wherein the coil and any of the first and second cores are in a non-contact state.

(5) The coil component according to any one of (1)-(4), wherein the coil and the case are in a non-contact state.

(6) The coil component according to any one of (1)-(5), wherein each of the first and second terminals is configured with: an insertion part that is inserted into and fixed to every one of the first and second outer walls; a coil end holding part that conductively holds an end of the coil; and a terminal part that is disposed on a bottom surface of every one of the first and second outer walls.

(7) The coil component according to (6), wherein each of the bottom surfaces of the first and second outer walls has a wall bottom recess, and the wall bottom recess is upwardly recessed, and the coil end holding part is disposed in the wall bottom recess.

(8) The coil component according to (7), wherein the wall bottom recess is configured with first and second wall bottom recesses, each of the first and second outer walls has a terminal arrangement part, and the terminal arrangement part is sandwiched between the first and second wall bottom recesses, and an arrangement direction of the first and second shafts is in parallel with an arrangement direction of the first wall bottom recess, the terminal arrangement part, and the second wall bottom recess.

(9) The coil component according to any one of (1)-(8), wherein the case further has a core holding member that holds the first connection member of the first core, and the first and second outer walls downwardly project from the core holding member.

(10) The coil component according to (9), wherein the first connection member is press-fit to the core holding member.

(11) The coil component according to any one of (1)-(10), wherein the coil is configured with first and second coils, the first coil is wound around one of the pair of first shafts and one of the pair of second shafts, and the second coil is wound around the other of the pair of first shafts and the other of the pair of second shafts, and the case further has a partition wall that separates a first region in which one of the pair of first shafts, one of the pair of second shafts, and the first coil are disposed from a second region in which the other of the pair of first shafts, the other of the pair of second shafts, and the second coil are disposed.

The coil component being thus described, it will be apparent that the same may be varied in many ways. Such variations are not to be regarded as a departure from the spirit and scope of the invention, and all such modifications as would be apparent to one of ordinary skill in the art are intended to be included within the scope of the following claims. Further, the above embodiments can be combined with each other and such combinations are not to be regarded as a departure from the spirit and scope of the invention.

What is claimed is:

1. A coil component comprising:

a core including:

a first shaft extending along a first direction;

a second shaft arranged parallel to the first shaft; and first and second opposed members, the first opposed member spanning between first ends of the first and second shafts along a second direction perpendicular to the first direction, the second opposed member spanning between second ends of the first and second shafts along the second direction;

a case supporting the core, the case being made of an insulating material, the case being U-shaped, the case including:

a top plate extending along the second direction, the top plate haying an opening therein;

first and second outer walls opposing each other, the top plate connecting between the first and second outer walls, each of the first and second outer walls extending along the first direction from the top plate, the core being disposed between the first and second outer walls;

a housing space formed as an inner space of the case, the housing space together with the first and second outer walls accommodating the core; and third and fourth outer walls opposing each other, the top plate connecting between the third and fourth outer walls, each of the third and fourth outer walls extending along the first direction from the top plate, the third and fourth outer walls having first and second U-shaped outer surfaces, respectively, the core being laterally exposed to an outside from the third and fourth outer walls;

a coil wound around the first and second shafts; and first and second metal terminals electrically connected to the coil, the first and second metal terminals being provided on the first and second outer walls, respectively, wherein the first and second opposed members are opposed to each other and sandwich the first and second shafts therebetween along the first direction, and the opening of the top plate receives the first opposed member to support the first opposed member in the opening.

2. The coil component according to claim 1, wherein the first and second outer walls have first and second inner surfaces, respectively, and the first and second inner surfaces face each other, and the first and second metal terminals are entirely disposed at external locations of the first and second outer walls than the first and second inner surfaces, respectively.

3. The coil component according to claim 1, wherein the coil has first and second ends, the first end is secured to the first metal terminal, and the second end is secured to the second metal terminal.

4. The coil component according to claim 1, wherein the coil is entirely spaced apart from the core.

5. The coil component according to claim 2, wherein the coil is entirely spaced apart from the core.

6. The coil component according to claim 1, wherein the coil is entirely spaced apart from the case.

7. The coil component according to claim 2, wherein the coil is entirely spaced apart from the case.

8. The coil component according to claim 4, wherein the coil is entirely spaced apart from the case.

9. The coil component according to claim 1, wherein each of the first and second terminals includes:

an insertion tab that is inserted into and engaged with each of the first and second outer walls;

a coil end retainer that conductively holds an end of the coil; and a terminal pad that is disposed on a bottom surface of each of the first and second outer walls.

10. The coil component according to claim 9,
wherein each of the bottom surfaces of the first and second outer walls has a recess, and
the coil end retainer is disposed in the recess.

11. The coil component according to claim 10,
wherein the recess includes first and second recesses,
each of the first and second outer walls has a terminal guide, and the terminal guide is located between the first and second recesses, and
the first and second shafts extend in parallel with an arrangement direction of the first recess, the terminal guide, and the second recess.

12. The coil component according to claim 1,
wherein the opening of the top plate of the case has a core retainer that holds the first opposed member of the core, and the top plate extends along a first plane, and
the first and second outer walls project from the top plate in the first direction perpendicular to an extending direction of the first plane.

13. The coil component according to claim 12,
wherein the first opposed member is press-fit to the core retainer.

14. The coil component according to claim 1,
wherein a first mating configuration of the first opposed member is fit into a second mating configuration of the case, and
a third mating configuration of the second opposed member is fit into a fourth mating configuration of the case.

15. The coil component according to claim 1,
wherein the coil further comprises first and second coils, the first coil is wound around the first shaft, and the second coil is wound around the second shaft, and
the case has a partition wall in the housing space that separates a first region in which the first coil and the first shaft are disposed from a second region in which the second coil and the second shaft are disposed.

16. The coil component according to claim 2,
wherein the coil further comprises first and second coils, the first coil is wound around the first shaft, and the second coil is wound around the second shaft, and
the case has a partition wall in the housing space that separates a first region in which the first coil and the first shaft are disposed from a second region in which the second coil and the second shaft are disposed.

17. The coil component according to claim 15,
wherein the first coil is entirely spaced apart from the first shaft, and the second coil is entirely spaced apart from the second shaft.

18. The coil component according to claim 1,
wherein the core further comprises first and second cores,
the first core includes a first part of the first shaft, the first opposed member, and a first part of the second shaft,
the second core includes a second part of the first shaft, the second opposed member, and a second part of the second shaft,
the first opposed member is connected between the first part of the first shaft and the first part of the second shaft, and the second opposed member is connected between the second part of the first shaft and the second part of the second shaft, and
the first core is fixed to the second core in an axial direction of the first and second shafts.

19. The coil component according to claim 2,
wherein the core further comprises first and second cores,
the first core includes a first part of the first shaft, the first opposed member, and a first part of the second shaft,
the second core includes a second part of the first shaft, the second opposed member, and a second part of the second shaft,
the first opposed member is connected between the first part of the first shaft and the first part of the second shaft, and the second opposed member is connected between the second part of the first shaft and the second part of the second shaft, and
the first core is fixed to the second core in an axial direction of the first and second shafts.

20. The coil component according to claim 15,
wherein the core further comprises first and second cores,
the first core includes a first part of the first shaft, the first opposed member, and a first part of the second shaft,
the second core includes a second part of the first shaft, the second opposed member, and a second part of the second shaft,
the first opposed member is connected between the first part of the first shaft and the first part of the second shaft, and the second opposed member is connected between the second part of the first shaft and the second part of the second shaft, and
the first core is fixed to the second core in an axial direction of the first and second shafts.

21. The coil component according to claim 1,
wherein the first and second opposed members are exposed to an outside via the opening of the top plate of the case and a bottom area of the case, respectively.

* * * * *